US011365515B2

(12) United States Patent
Luo et al.

(10) Patent No.: US 11,365,515 B2
(45) Date of Patent: Jun. 21, 2022

(54) FOAM ASSISTED APPLICATION OF STRENGTH ADDITIVES TO PAPER PRODUCTS

(71) Applicant: SOLENIS TECHNOLOGIES, L.P., Wilmington, DE (US)

(72) Inventors: Mingxiang Luo, Wilmington, DE (US); John C. Gast, Wilmington, DE (US); Terry Bliss, Wilmington, DE (US); Zachary Hier, Wilmington, DE (US); Matthew Nicholas, Wilmington, DE (US)

(73) Assignee: Solenis Technologies, L.P., Wilmington, DE (US)

( * ) Notice: Subject to any disclaimer, the term of this patent is extended or adjusted under 35 U.S.C. 154(b) by 35 days.

(21) Appl. No.: 16/226,891

(22) Filed: Dec. 20, 2018

(65) Prior Publication Data

US 2019/0309480 A1 Oct. 10, 2019

Related U.S. Application Data

(60) Provisional application No. 62/691,125, filed on Jun. 28, 2018, provisional application No. 62/652,788, filed on Apr. 4, 2018.

(51) Int. Cl.
*D21H 21/56* (2006.01)
*D21H 21/18* (2006.01)
(Continued)

(52) U.S. Cl.
CPC ..... *D21H 21/56* (2013.01); *B65D 65/42* (2013.01); *D21H 11/14* (2013.01); *D21H 17/41* (2013.01);
(Continued)

(58) Field of Classification Search
CPC ..... D21H 21/56; D21H 17/41; D21H 17/455; D21H 21/18; D21H 23/24; D21H 11/14; D21H 27/10; D21H 17/45; B65D 65/42
(Continued)

(56) References Cited

U.S. PATENT DOCUMENTS 3,141,857 A 7/1964 Sommer et al.
3,210,240 A 10/1965 Read et al.
(Continued)

FOREIGN PATENT DOCUMENTS

WO 2003040473 A2 5/2003
WO 03/102302 A1 12/2003
(Continued)

OTHER PUBLICATIONS

Kinnunen-Raudaskoski, K. et al., "Increased Dryness after Pressing and Wet Web Strength by Utilizing Foam Application Technology", TAPPI, 2015 PaperCon Conference.
(Continued)

*Primary Examiner* — Michael A Salvitti
(74) *Attorney, Agent, or Firm* — Lorenz & Kopf, LLP

(57) ABSTRACT

A foaming formulation is provided herein. The foaming formulation includes at least one foaming agent in an amount of from about 0.001% to about 10% by weight based on a total weight of the foaming solution. The foaming formulation further includes a synthetic strength additive having a cationic functional group in an amount from about 0.01% to about 50% by weight based on a total weight of the foaming solution. The foaming formulation further includes water.

18 Claims, 20 Drawing Sheets

(51) Int. Cl.

| | |
|---|---|
| ***D21H 17/45*** | (2006.01) |
| ***D21H 17/41*** | (2006.01) |
| ***B65D 65/42*** | (2006.01) |
| ***D21H 23/24*** | (2006.01) |
| ***D21H 11/14*** | (2006.01) |
| ***D21H 27/10*** | (2006.01) |

(52) U.S. Cl.
CPC ..... *D21H 17/45* (2013.01); *D21H 17/455* (2013.01); *D21H 21/18* (2013.01); *D21H 23/24* (2013.01); *D21H 27/10* (2013.01)

(58) Field of Classification Search
USPC ..... 162/101; 516/18
See application file for complete search history.

(56) References Cited

U.S. PATENT DOCUMENTS 4,081,318 A 3/1978 Wietsma
4,158,076 A 6/1979 Wallsten
4,571,360 A 2/1986 Brown et al.
4,581,254 A * 4/1986 Cunningham ..... D21H 5/0042 427/244
4,597,831 A 7/1986 Anderson
4,606,944 A 8/1986 Lauchenauer
6,090,754 A 7/2000 Chan et al.
6,607,783 B1 8/2003 Vander Heiden et al.
7,556,684 B2 * 7/2009 Bury ..... C04B 28/02 106/724
2004/0118540 A1 6/2004 Garnier et al.
2005/0188896 A1 * 9/2005 Bury ..... C04B 40/0039 106/708
2008/0060546 A1 * 3/2008 Symons ..... B01F 7/00908 106/12
2019/0152854 A1 * 5/2019 Schlesinger ..... C04B 28/008
2019/0309480 A1 * 10/2019 Luo ..... D21H 11/14

FOREIGN PATENT DOCUMENTS

WO 2017079310 A1 5/2017
WO 20170174560 A1 10/2017
WO WO 2017/174560 * 10/2017

OTHER PUBLICATIONS

Kinnunen-Raudaskoski, K. et al., "Thin Barrier and Other Functional Coatings for Paper by Foam Coating", TAPPI, 2015 PaperCon Conference.
Eklund, R.W., et al., "Foamcote: high-speed application of foamed starch to a paper web", TAPPI Journal, May 1986, p. 70-74.
Kenttä, E., et al., "Functional surfaces produced by foam coating", TAPPI Journal, Aug. 2016, p. 515-521, vol. 15, No. 8.
Skelton, J., "Foam assisted dewatering—a new technology emerges", Paper Technology and Industry (PTI), Mar. 1987, p. 434-436.
ISA/US, International Preliminary Report on Patentability and Written Opinion issued in Int. Appl. No. PCT/US2018/066672 dated Oct. 15, 2020.

* cited by examiner

FOAM ASSISTED APPLICATION OF STRENGTH ADDITIVES TO PAPER PRODUCTS

CROSS-REFERENCE TO RELATED APPLICATION

This application claims the benefit of U.S. Provisional Application No. 62/652,788, filed Apr. 4, 2018 and U.S. Provisional Application No. 62/691,125, filed Jun. 28, 2018, which are all hereby incorporated in their entirety by reference.

TECHNICAL FIELD

The present disclosure relates to the field of applying additives to embryonic paper webs. More particularly, the present disclosure relates to the application of strength additives using foaming techniques to wet, newly formed embryonic webs.

BACKGROUND

In paper manufacturing, additives are introduced into the paper making process to improve paper properties. For example, known additives improve paper strength, drainage properties, retention properties, and so on.

In a conventional paper-making machine, pulp is refined in a stock preparation system. Chemical additives, dyes, and fillers are sometimes added into the stock in the stock preparation system, which operates at 2.5-5% consistency. In the thin stock circuit of the stock preparation system, the pulp is diluted from about 2.5-3.5% consistency to about 0.5-1.0% consistency in a fan pump. During this dilution, additional chemical additives may be added to the pulp. Addition of chemical additives at either of these positions in the stock preparation system would be considered "wet end addition" as used herein. The 0.5-1.0% consistency stock is then typically pumped through machine cleaners, a machine screen, and a deaerator (if present) and to a headbox. From the headbox, the 0.5-1.0% consistency slurry is spread onto a moving continuous forming fabric. The forming fabric may have the form of a woven mesh. Most of the water drains through the forming fabric, and the fibers are retained on the forming fabric, as it travels along in the machine direction from the headbox to the press section. As water drains away, the water content of the embryonic sheet may drop from about 99-99.5% water to about 70-80% water. Further water may be removed in a press section, from which press section the sheet may exit with a consistency of about 40-50% solids. Further water is typically removed from the sheet in a dryer section, from which the sheet may exit at about 90-94% solids. The sheet may then optionally be calendered and then collected on a reel.

As explained above, chemical additives, such as strength additives, may be introduced into the pulp at the stock preparation section, in what is known as "wet-end addition". Strength additives are typically added to improve the fiber bonding of the final paper product. Improved fiber bonding in the final paper product improves strength parameters (such as the dry tensile strength) of the paper product.

Further improvements in bonding-related paper strength parameters, such as the dry tensile strength, are desirable.

BRIEF SUMMARY

This summary is provided to introduce a selection of concepts in a simplified form that are further described below in the detailed description section.

In an exemplary embodiment, there is provided a foaming formulation, which could be a solution, a suspension, or an emulsion, comprising: at least one foaming agent in an amount of from about 0.001% to about 10% by weight based on a total weight of the foaming formulation; a synthetic strength additive in an amount from about 0.01% to about 50% by weight based on a total weight of the foaming formulation, the synthetic strength additive comprising a cationic functional group; and water. The at least one foaming agent comprises at least one of: a nonionic foaming agent selected from group of ethoxylates, alkoxylated fatty acids, polyethoxy esters, glycerol esters, polyol esters, hexitol esters, fatty alcohols, alkoxylated alcohols, alkoxylated alkyl phenols, alkoxylated glycerin, alkoxylated amines, alkoxylated diamines, fatty amide, fatty acid alkylol amide, alkoxylated amides, alkoxylated imidazoles, fatty amide oxides, alkanol amines, alkanolamides, polyethylene glycol, ethylene and propylene oxide, EO/PO copolymers and their derivatives, polyester, alkyl saccharides, alkyl, polysaccharide, alkyl glucosides, alkyl polygulocosides, alkyl glycol ether, polyoxyalkylene alkyl ethers, polyvinyl alcohols and their derivatives, alkyl polysaccharides, and combinations thereof; a zwitterionic or amphoteric foaming agent selected from the group of lauryl dimethylamine oxide, cocoamphoacetate, cocoamphodiacetate, cocoamphodiproprionate, cocamidopropyl betaine, alkyl betaine, alkyl amido betaine, hydroxysulfo betaine, cocamidopropyl hydroxysultain, alkyliminodipropionate, amine oxide, amino acid derivatives, alkyl dimethylamine oxide and combinations thereof or a cationic foaming agent selected from the group of alkyl amine and amide and their derivatives, alkyl ammoniums, alkoxylated amine and amide and their derivatives, fatty amine and fatty amide and their derivatives, quaternary ammoniums, alkyl quaternary ammoniums and their derivatives and their salts, imidazolines derivatives, carbyl ammonium salts, carbyl phosphonium salts, polymers and copolymers of structures described above, and combinations thereof.

In another exemplary embodiment, there is provided a foaming formulation for producing a foam with a target gas content upon incorporation of gas into the foaming formulation. The foaming formulation includes at least one foaming agent in an amount of from about 0.001% to about 10% based on a total weight of the foaming formulation; at least one synthetic strength additive in an amount of from about 0.01% to about 50% of the total amount of the foaming formulation, the at least one synthetic strength additive comprising a cationic functional group; and water. The concentration of the at least one foaming agent in the foaming formulation is substantially minimally sufficient to produce the target gas content of the foam after gas is incorporated into the foaming formulation.

In another exemplary embodiment, there is provided a method of introducing a synthetic strength additive into paper product, the synthetic strength additive comprising a cationic functional group. The method includes the step of producing a foam from a foaming formulation, the foaming formulation comprising: at least one foaming agent in an amount of from about 0.001% to about 10% by weight based on a total weight of the foaming formulation; a synthetic cationic strength additive in an amount from about 0.01% to about 50% by weight based on a total weight of the foaming formulation; and water. The method also includes the step of applying the foam to a wet formed embryonic web.

Other desirable features will become apparent from the following detailed description and the appended claims, taken in conjunction with the accompanying drawings and this background.

BRIEF DESCRIPTION OF THE DRAWINGS

A more complete understanding of the subject matter may be derived from the following detailed description taken in conjunction with the accompanying drawings, wherein like reference numerals denote like elements, and wherein.

DETAILED DESCRIPTION

The following detailed description is merely illustrative in nature and is not intended to limit the embodiments of the subject matter or the application and uses of such embodiments. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the systems and methods defined by the claims. Furthermore, there is no intention to be bound by any expressed or implied theory presented in the preceding Technical Field, Background, Brief Summary or the following Detailed Description. For the sake of brevity, conventional techniques and compositions may not be described in detail herein.

Embodiments of the present disclosure relate to introducing additives to paper substrates via a foam assisted application technique.

Figure 1:
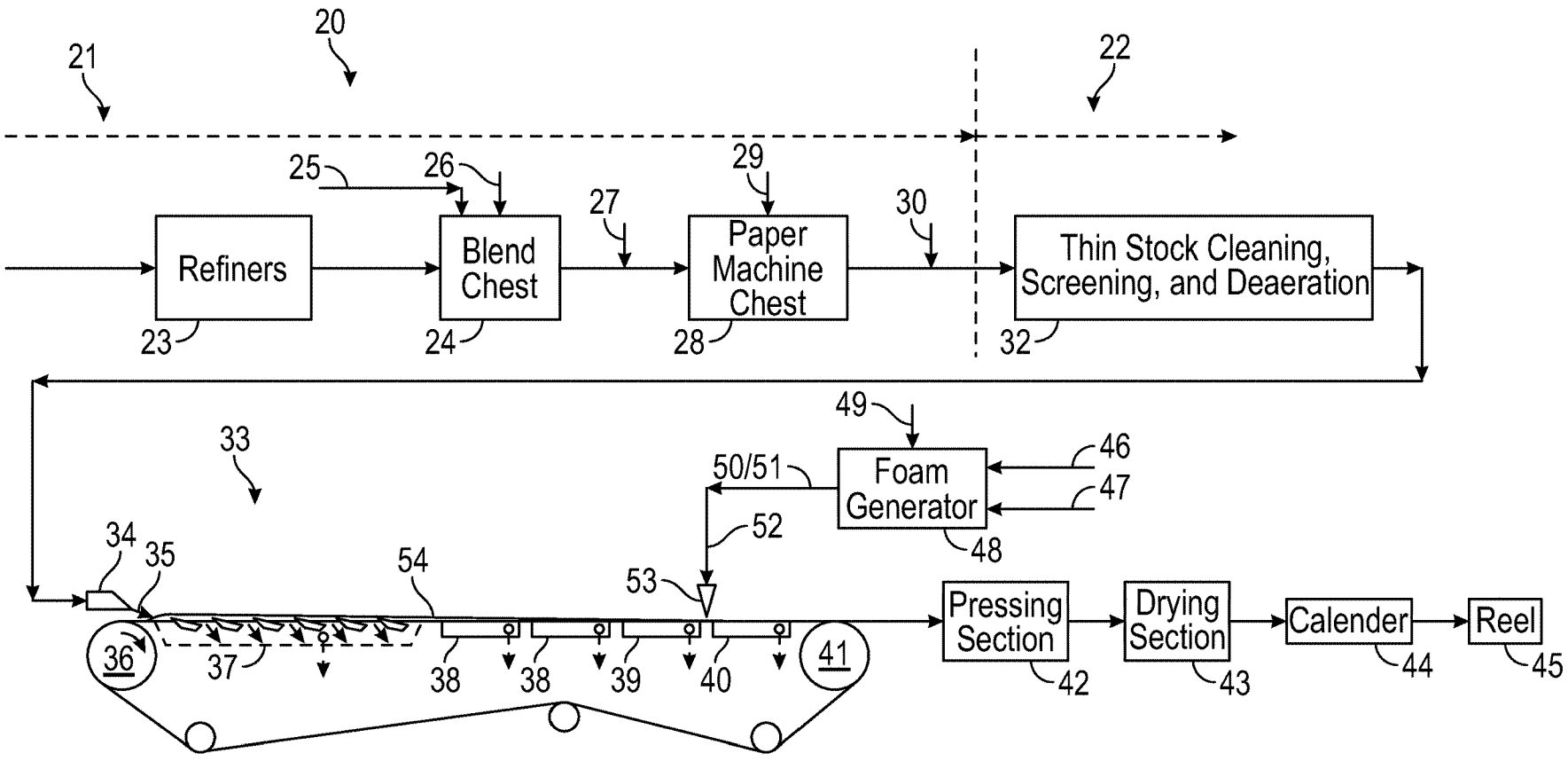
FIG. 1 shows a schematic of a paper-making system in accordance with various embodiments.

A schematic of a system for applying a foamed formulation to a wet embryonic web is shown in FIG. 1. The system includes a stock preparation section 20 which includes a thick stock circuit 21 and a thin stock circuit 22 (each circuit being illustrated in this figure using dashed arrows). In this figure, the flow of the stock is illustrated using solid arrows. In an embodiment, the thick stock section 21 comprises one or more refiners 23 configured to improve fiber-fiber bonding in the thick stock by making fibers of the thick stock more flexible and by increasing their surface area through mechanical action of the thick stock at about 2.0-5.0% consistency. In an embodiment, subsequent to the refiners, the thick stock enters a blend chest 24. In the blend chest 24, the stock may optionally be blended with stock from other sources 25. Additionally, the stock may be blended with chemical additives 26 in the blend chest 24. After exiting from the blend chest 24, the stock may be diluted through the addition of water 27 in order to control the consistency of the stock to be within a pre-determined target range. The stock then enters a paper machine chest 28, where additional chemical additives 29 may be added. In an embodiment, as the stock exits from the paper machine chest 28, the stock is diluted with a large amount of water 30 to control the consistency of the stock to be about 0.5-1.0%. The stock with a consistency of about 0.5-1.0% then enters the thin stock circuit 22.

In an exemplary embodiment, within the thin stock circuit 22, the stock may pass through low consistency cleaning, screening, and deaeration devices 32. In exemplary embodiments, additional chemical additives may be added to the stock during the processes occurring within these cleaning, screening, and deaeration devices 32. After the thin stock cleaning, screening and deaeration processes, the stock enters a forming section 33. In exemplary embodiments, in the forming section 33, a headbox 34 distributes the stock 35 onto a moving woven fabric (the "forming fabric") 36. In exemplary embodiments, the forming fabric 36 transports the stock over one or more boxes of hydrafoils 37, which serve to drain water from the stock and thereby increase the consistency of the stock to form an embryonic web 54. In exemplary embodiments, when the web 54 is about 2 to 3% consistency, the web 54 then passes over one or more low vacuum boxes 38, which are configured to apply a "low" vacuum to the web 54 in order to remove additional water from the web 54. After the web 54 has passed over the one or more low vacuum boxes 38, in exemplary embodiments, the web 54 may subsequently pass over one or more "high" vacuum boxes 39, 40, where a higher vacuum force removes additional water until the web 54 has about a 10-20% consistency. In exemplary embodiments, additional water is then removed under vacuum by the final roll, the couch roll 41. Following the couch roll 41, the wet web 54 enters the pressing section 42 at about 20-25% consistency, where press rolls press additional water from the wet web 54. The web 54 exits the pressing section at about 40-50% consistency, and enters a drying section 43, where heated dryer cylinders heat the web 54 and evaporate additional water from the web 54. After the drying section 43 the web 54 is converted to paper having about 93-95% consistency. Following the drying section 43, the now-dry paper may be smoothed by a calender 44 and reeled by a reel 45.

In exemplary embodiments, additives such as strength additives may be added to the web 54 through foam-assisted application. In particular, in an exemplary embodiment, a foaming agent 46 and a chemical strength additive 47 are blended in a foam generator 48 to create a foaming formulation 50. Gas 49 is incorporated into the foaming formulation 50 to form a foam 51. In an alternative embodiment, the foaming agent 46 and strength additive 47 are blended in another device to form a foaming formulation 50, and gas 49 is subsequently incorporated into the foaming formulation 50 to form a foam 51. In an exemplary embodiment, after the incorporation of gas into the foaming formulation 50, the resultant foam 51 is conveyed via a hose 52 to a foam distributor 53, where the foam is applied onto the embryonic web 54. In an exemplary embodiment, the foam 51 is applied between a first high vacuum box 39 and a second high vacuum box 40. The vacuum created by the high vacuum box 40 following the foam application draws the foam 51 into the wet embryonic web 54.

As will be explained in more detail below, it has been surprisingly observed that the application of certain strength additives through a foam assisted addition technique, in combination with certain foaming agents, results in an improvement (or, in some scenarios, at least equivalent performance) in bonding-related paper strength properties of paper products as compared to paper products where the same chemical strength additives are added through wet-end addition. Previously, foaming agents were known to reduce paper strength properties due to the foaming agents disrupting bonding between pulp fibers of the paper.

As used herein, the term "foaming agent" defines a substance which lowers the surface tension of the liquid medium into which it is dissolved, and/or the interfacial tension with other phases, to thereby be absorbed at the liquid/vapor interface (or other such interfaces). Foaming agents are generally used to generate or stabilize foams.

In an exemplary embodiment, foamed additives may be applied to the wet embryonic web 54 of fibers as this wet formed web 54 passes over the vacuum boxes 38, 39, 40. As water is removed from the wet embryonic web 54 of fibers, the strength additive 47 is drawn into the web 54 and retained within the web by a combination of electrostatic and physical means.

Strength additives typically function by increasing the total bonded area of fiber-fiber bonds, not by making the individual fibers of the web stronger. Increased bonded area of fibers, and the subsequent increased bonding-related sheet strength properties, can be achieved through other techniques as well. For example, increased fiber refining, sheet wet pressing, and improved formation may be used to increase the bonded area of fibers. In certain cases, the improvement in fiber bonding-related paper strength properties achieved through the foam assisted application of strength additives was shown to be larger than the wet-end addition of the same strength additives. In particular, one advantage associated with the foam assisted application of strength additives is that a higher concentration of strength additives can be introduced into the wet formed sheet, whereas the practical dosage range of strength additives limits the concentration of wet end additives in the very low consistency environment of traditional wet-end addition. In traditional wet-end addition, the limitation of dosage of strength additives leads to bonding-related sheet strength property "plateauing" of the dose-response curve at relatively low dosages, whereas the foam assisted addition of strength additives led to a continued dosage response, where an increase in the concentration of strength additives applied to the wet sheet resulted in an increase in the strength properties of the resultant paper product, even at much higher than normal dose applications.

In an exemplary embodiment, the strength additive is a synthetic strength additive comprising a cationic functional group, for example a cationic strength additive or an amphoteric strength additive. As explained in more detail below, is noted that synthetic strength additives having a cationic functional group improve the bonding related strength properties of the final paper sheet.

Without being bound by theory, it may be that the improvement in paper bonding related strength properties achieved through the foam assisted application of certain strength additives as compared to wet end addition of the same additives is that there is a better retention of the additives with foam assisted application. In particular, since the foamed application of additives is performed when the sheet has a higher concentration of fibers to water (with the water content typically being around 70-90%) as compared to the wet-end addition of strength additives to the pulp in the stock preparation sections (where the water content is typically around 95-99% or more), less strength additive loss occurs when the pulp is passed through subsequent water removal sections. In exemplary embodiments, the step of applying foam to the wet formed embryonic web is performed when the wet formed embryonic web has a pulp fiber consistency of between about 5% to about 45%, for example between about 5% and about 30%.

Without being bound by theory, it is believed that the improvement in paper strength parameters resulting from the foam assisted application of certain strength additives as compared to the wet end addition of the same additives is because contaminating substances/contaminants that interfere with the additive adsorption of the strength additives onto the fibers may be present in greater quantities in the stock preparation section, as will be explained in more detail below.

Without being bound by theory, it is believed that the improvement in paper parameters resulting from the foam assisted application of certain strength additives as compared to the wet-end addition of the same additives is that, because the strength additives are incorporated into the sheet at least in part by a physical means instead of only by a surface charge means, a lack of remaining available charged sites in the forming web does not limit the amount of strength additive that can be incorporated into the sheet. A lack of remaining available charged bonding sites in the forming web, such as a lack of remaining available anionic charged sites, may occur when additives are introduced by wet end addition, especially when large amounts of additives are introduced in this manner.

In an exemplary embodiment, the foam assisted application of strength additives is applied to the sheet with the foam having an air content of between about 40% and about 95%, for example between about 60% and about 80%. The foam may be formed by injecting gas into a foaming formulation, by shearing a foaming formulation in the presence of sufficient gas, by injecting a foaming formulation into a gas flow, or by other suitable means.

Without being limited by theory, it is noted that when a small batch of foaming formulation is foamed by incorporating air into the liquid by means of a high speed homogenizer in a container, the amount of gas that is dispersed into fine bubbles in the range of 10-300 micro-meters diameter is limited by the characteristics and concentration of the foaming agent and its interaction with the strength additive. For a given type and concentration of the foaming agent, a maximum gas content is typically achieved within less than a minute. Further homogenizing cannot entrain more gas as 10-300 micro-meter diameter bubbles; any additional gas drawn into the vortex is dispersed as much larger bubbles in the range of 2-20 mm diameter. Bubbles of this size quickly coalesce and float to the top of the foam, where they typically burst, and the gas exits the foam. When excess gas, beyond that which the type and concentration of the foaming agent in the foaming formulation can disperse as 10-300 micrometer bubbles, in a pressurized mechanical shear type foam generator device, the excess gas is discharged (with the foam) as very large 2-20 mm diameter bubbles, dispersed within the foam. Bubbles of 2-20 mm diameter are much larger in diameter than the typical thickness of the wet embryonic sheet. Since strength additives are only found in the liquid film and interstice area of the bubbles in the foam, very large diameter bubbles cannot deliver the strength additive to the fiber crossing area if a large area of the sheet has only the film over a single bubble applied to the sheet. Bubbles smaller than the foam layer thickness, especially bubbles smaller than the embryonic web thickness, are preferred for a more even distribution of strength additives. Bubbles of 20-300 micrometers diameter are preferred, especially bubbles of 50-150 micrometer diameter, for this application, because bubbles of this size can carry the strength additive into the embryonic web without disruption of the web and can therefore more efficiently distribute the strength additive. A foam containing bubbles of 50-150 micrometers diameter and from about 70 to about 80% air is convenient because it can be poured readily from an open top container or conveyed by pressure through a hose to and out of a foam distributor to the embryonic web for application.

In an exemplary embodiment, the foam assisted application of strength additives is performed using a foaming formulation including at least one foaming agent in an amount of from about 0.001% to about 10% by weight, based on a total weight of the foaming solution, for example from about 0.01% to about 1% by weight, based on a total weight of the foaming formulation. In an exemplary embodiment, the foam assisted application is performed using a foaming formulation including at least one strength additive in an amount of from about 0.01% to about 50% by weight, based on a total weight of the foaming formulation, for example from about 0.1% to about 10% by weight, based on a total weight of the foaming formulation.

In particular, as explained above, foaming agents generally reduce bonding-related paper strength parameters by disrupting bonding between pulp fibers. It was observed that the use of a foaming formulation having about the minimum amount of foaming agent sufficient to produce a foam minimizes the reduction of bonding-related paper strength parameters in this manner. In particular, it was observed that the dosage of foaming agent required to effectively disperse a certain amount of a strength additive in a foam having gas bubbles of primarily 50-150 micrometers diameter and a gas content of between 70% and 80% may vary in relation to the type and dosage of the strength additive, and the foaming formulation temperature and pH. This amount of foaming agent is defined herein as the "minimally sufficient" foaming agent dose, and is desirable to reduce the negative effects many foaming agents have on fiber bonding, and also to reduce cost and reduce potential subsequent foaming problems elsewhere in the paper machine white water circuit.

Figure 2:
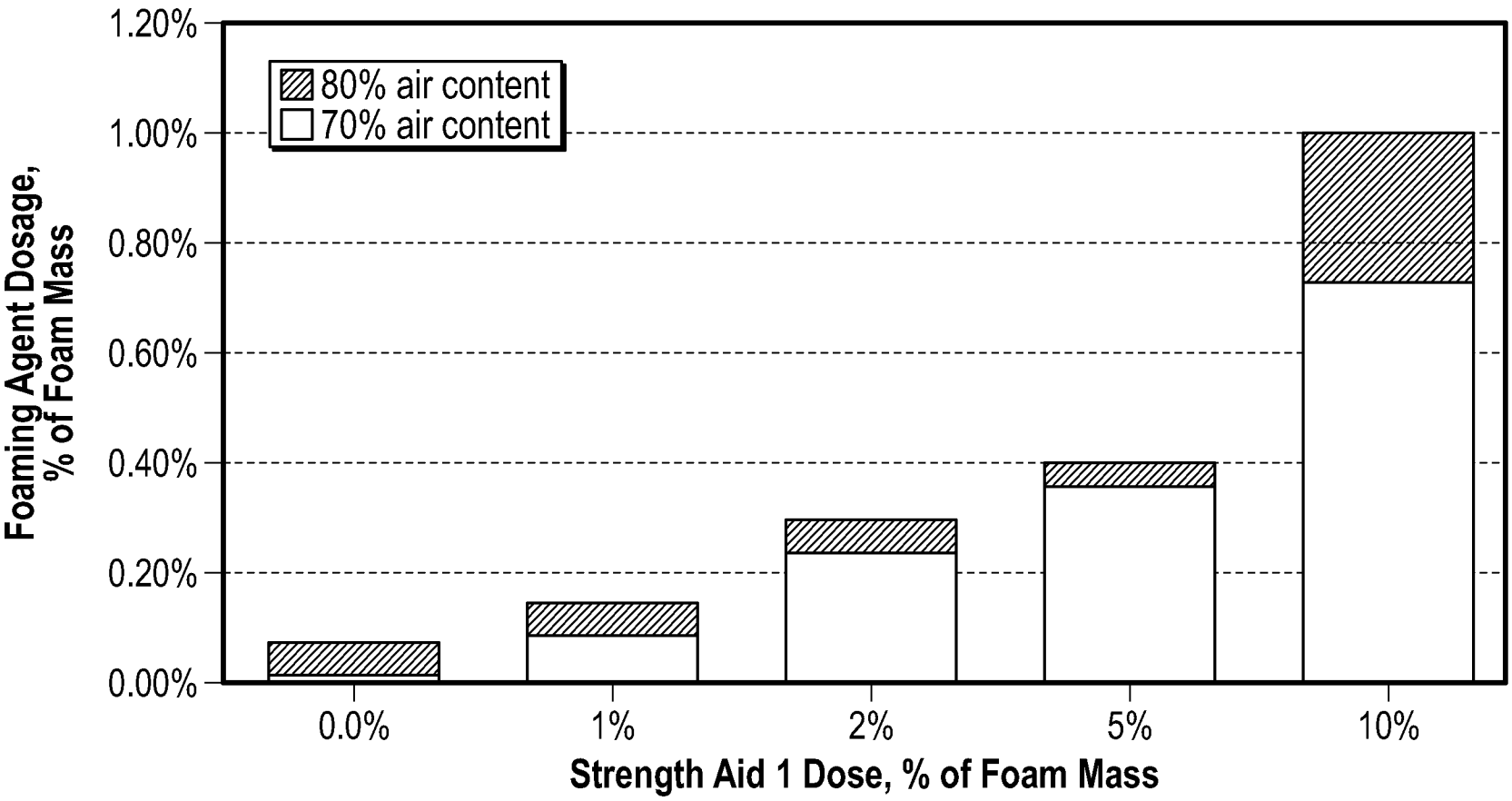
FIG. 2 shows a graph of the relative amounts of strength additive and foaming agent needed to achieve certain target foam air contents.

FIG. 2 shows a graph detailing the difference in foaming agent concentration required to generate foams of 70% and 80% gas content at specific strength additive dosages, within the foaming formulation. In all cases, the determined foaming agent concentration was that which resulted in about all of the gas bubbles within the preferred diameter range of 50-150 micro-meters. Adding a foaming agent in excess of about the minimally sufficient dose of foaming agent required to produce a foam with the targeted gas content increases the likelihood of loss of bonding-related strength properties and therefore the increase in the magnitude of the strength parameter loss. Use of excessive foaming agent beyond that required to produce a foam, for example using an excessive amount of foaming agent of more than about 10% by weight of the foaming solution, also increases the total cost of the treatment.

Some foaming agent and strength additive combinations were observed to result in a larger improvement in bonding-related strength properties of the paper than other foaming agent and strength additive combinations, when applied as a foamed formulation to the embryonic web. Without being bound by theory, it may be that these differences in improvement is due to the differing amounts of different foaming agents required to reach a target gas content in the foam, and the differing impact this may have on the final paper sheet strength. In an exemplary embodiment, the target gas content for the foam produced after the incorporation of gas into the foaming formulation is from about 40% gas to about 95% gas, based on a total volume of the foam, for example from about 60% gas to about 80% gas, based on a total volume of the foam.

In particular, the inventors recognized that not all types of foaming agents were satisfactory in all circumstances. Some foaming agents, such as the anionic foaming agent sodium dodecyl sulfate (SDS), tended to result in a decrease in bonding-related strength parameters of the final paper sheet. SDS is conventionally known as a preferred foaming agent because of its low cost and the small dose normally required to achieve a target gas content in the foam. However, the inventors discovered that the anionic charge of SDS tends to interfere with preferred synthetic strength additives that have a cationic functional group and result in the formation of a gel. This gel formation creates foam handling problems and inhibits the migration of the foamed strength additive into the embryonic web. Even under ideal circumstances (with no charge interference occurring between SDS and the cationic-group-containing strength additive) SDS still acts to reduce strength due to bonding interference. The inventors have further established that certain other types of foaming agents were unable to produce a foam of the targeted gas content range, unless cost-prohibitive concentrations of the foaming agent were used.

An investigation was performed into which foaming agents produced foams with the desired qualities of gas content and bubble size range for the foam assisted application of certain strength additives in the above-described manner.

It was observed that improved physical parameters in the investigative paper sheet samples were obtained when the foam applied to the samples had a gas content of between about 40% and about 95%, for example between about 60% and about 80%. In an exemplary embodiment, the gas is air. In various exemplary embodiments, the foams are formed by shearing a foaming formulation in the presence of sufficient gas, or by injecting gas into the foaming solution, or by injecting the foaming solution into a gas flow.

It was also observed that improved physical properties of the paper sheet samples were obtained when the foaming formulation included one or more foaming agents in an amount of from about 0.001% to about 10% by weight, based on a total weight of the foaming formulation, for example from about 0.01% to about 1% by weight, based on a total weight of the foaming formulation. Still further, it was observed that improved physical properties of the paper sheet samples resulted when the amount of foaming agent was minimized to only about that sufficient to produce a foam with a target gas content.

It was also observed that improved physical parameters in the paper sheet samples were obtained when one or more strength additives were present in an amount from about 0.01% to about 50% by weight in the foaming formulation, for example from about 0.1% to about 10% by weight, based on a total weight of the foaming formulation. In exemplary embodiments, the strength additives comprise synthetic strength additives having a cationic functional group. In an exemplary embodiment, the synthetic strength additive comprises a graft copolymer of a vinyl monomer and functionalized vinyl amine, a vinyl amine containing polymer, or an acrylamide containing polymer. It is noted that, as used herein, the term "synthetic" strength additive excludes natural strength additives, such as starch strength additives. In an exemplary embodiment, the at least one synthetic strength additive having a cationic functional group is selected from the group of: acrylamide-diallyldimethylammonium chloride copolymers; glyoxylated acrylamide-diallyldimethylammonium chloride copolymers; vinylamine containing polymers and copolymers; polyamidoamine-epichlorohydrin polymers; glyoxylated acrylamide polymers; polyethyleneimine; acryloyloxyethyltrimethyl ammonium chloride. An exemplary synthetic strength additive including a graft copolymer of a vinyl monomer and functionalized vinyl amine is commercially available from Solenis LLC of Wilmington, Del., under the trade name Hercobond™ 7700.

Additionally or alternatively, in an exemplary embodiment, the at least one synthetic strength additive having a cationic functional group is selected from the group of DADMAC-acrylamide copolymers, with or without subsequent glyoxylation; Polymers and copolymers of acrylamide with cationic groups comprising AETAC, AETAS, METAC, METAS, APTAC, MAPTAC, DMAEMA, or combinations thereof, with or without subsequent glyoxylation; Vinylamine containing polymers and copolymers; PAE polymers; Polyethyleneimines; Poly-DADMACs; Polyamines; and Polymers based upon dimethylaminomethyl-substituted acrylamide, wherein: DADMAC is diallyldimethylammonium chloride; DMAEMA is dimethylaminoethylmethacrylate; AETAC is acryloyloxyethyltrimethyl chloride; AETAS is acryloyloxyethyltrimethyl sulfate; METAC is methacryloyloxyethyltrimethyl chloride; METAS is methacryloyloxyethyltrimethyl sulfate; APTAC is acryloylamidopropyltrimethylammonium chloride; MAPTAC is acryloylamidopropyltrimethylammonium chloride; and PAE is polyamidoamine-epichlorohydrin polymers.

It was observed that the preferred foaming agents for use in foam assisted application of synthetic strength additives having a cationic functional group were foaming agents selected from subsets of the groups of nonionic, zwitterionic, amphoteric or cationic types of foaming agents, or combinations of the same type or more than one type of these foaming agents. In particular, preferred foaming agents are selected from the group of nonionic foaming agents, zwitterionic foaming agents, amphoteric foaming agents, and combinations thereof.

Without being bound by theory, the improved results in strength parameters obtained by the nonionic and zwitterionic or amphoteric foaming agents were believed to be due to the lack of electrostatic interaction between these types of foaming agents and the pulp fibers and the synthetic cationic strength additives. In particular, improved results were obtained through the use of nonionic foaming agents selected from the group of ethoxylates, alkoxylated fatty acids, polyethoxy esters, glycerol esters, polyol esters, hexitol esters, fatty alcohols, alkoxylated alcohols, alkoxylated alkyl phenols, alkoxylated glycerin, alkoxylated amines, alkoxylated diamines, fatty amide, fatty acid alkylol amide, alkoxylated amides, alkoxylated imidazoles, fatty amide oxides, alkanol amines, alkanolamides, polyethylene glycol, ethylene and propylene oxide, EO/PO copolymers and their derivatives, polyester, alkyl saccharides, alkyl, polysaccharide, alkyl glucosides, alkyl polygulocosides, alkyl glycol ether, polyoxyalkylene alkyl ethers, polyvinyl alcohols, alkyl polysaccharides, their derivatives and combinations thereof.

Improved results in strength parameters were also obtained through the use of zwitterionic or amphoteric foaming agents selected from the group of lauryl dimethylamine oxide, cocoamphoacetate, cocoamphodiacetate, cocoamphodiproprionate, cocamidopropyl betaine, alkyl betaine, alkyl amido betaine, hydroxysulfo betaine, cocamidopropyl hydroxysultain, alkyliminodipropionate, amine oxide, amino acid derivatives, alkyl dimethylamine oxide and nonionic surfactants such as alkyl polyglucosides and poly alkyl polysaccharide and combinations thereof.

It was observed that anionic foaming agents may also produce improved results in strength parameters when combined with synthetic strength additives having a cationic functional group that have a relatively low cationic charge, for example a molar concentration of cationic functional groups of below around 16%. Preferred anionic foaming agents are foaming agents selected from the group of alkyl sulfates and their derivatives, alkyl sulfonates and sulfonic acid derivatives, alkali metal sulforicinates, sulfonated glyceryl esters of fatty acids, sulfonated alcohol esters, fatty acid salts and derivatives, alkyl amino acids, amides of amino sulfonic acids, sulfonated fatty acids nitriles, ether sulfates, sulfuric esters, alkylnapthylsulfonic acid and salts, sulfosuccinate and sulfosuccinic acid derivatives, phosphates and phosphonic acid derivatives, alkyl ether phosphate and phosphate esters, and combinations thereof.

It was observed that cationic foaming agents may also produce improved results in strength parameters when combined with synthetic strength additives having a cationic functional group that have a relatively low cationic charge, for example a molar concentration of cationic functional groups of below around 16%. Preferred cationic foaming agents are foaming agents selected from the group of alkyl amine and amide and their derivatives, alkyl ammoniums, alkoxylated amine and amide and their derivatives, fatty amine and fatty amide and their derivatives, quaternary ammoniums, alkyl quaternary ammoniums and their derivatives and their salts, imidazolines derivatives, carbyl ammonium salts, carbyl phosphonium salts, polymers and copolymers of structures described above, and combinations thereof.

Combinations of the above-described foaming agents are also disclosed herein. Combining certain different types of foaming agents allows for the combination of different benefits. For example, anionic foaming agents are generally cheaper than other foaming agents and are generally effective at producing foam, but may not be as effective at improving the bonding-related strength properties of paper. Nonionic, zwitterionic or amphoteric foaming agents are generally more costly than anionic foaming agents, but are generally more effective in conjunction with synthetic strength additives having a cationic functional group at improving strength properties. As such, the combination of an anionic and a nonionic, zwitterionic, and/or amphoteric foaming agent may provide the dual benefits of being cost-effective whilst also improving strength properties of the paper sheet, or at least provide a compromise between these two properties. Foaming agents may also be combined to take advantage of the high foaming capabilities of one type of foaming agent and the better bonding improvement properties of another type of foaming agent. With certain combinations, there exists a synergistic improvement in bonding-related strength properties with the use of certain foaming agents and certain strength additives having a cationic functional group, for example cationic or amphoteric strength additives. Anionic or non-ionic strength additives may also exhibit such synergies with certain foaming agents or combinations thereof.

In an exemplary embodiment, the foaming agent is poly (vinyl alcohol), also called polyvinylalcohol, PVA, PVOH, or PVA1 and its derivatives. The combination of a PVOH foaming agent and a strength additive having a cationic functional group was observed to provide improved strength properties on the samples as compared to those resulting from wet end addition of the same synthetic cationic strength additive. Polyvinyl alcohol foaming agents with higher molecular weight, a lower degree of hydrolysis and the absence of defoamers typically provided good strength properties through the foam assisted application of strength additives. In an exemplary embodiment, the polyvinyl alcohol has a degree of hydrolysis of between around 70% and 99.9%, for example between around 86 and around 90%. In an exemplary embodiment, the polyvinyl alcohol foaming agent has a number average molecular weight of between about 5000-about 400,000, resulting in a viscosity of between around 3 and 75 cP at 4% solids and 20° C. In an exemplary embodiment, the polyvinyl alcohol foaming agent has a number average molecular weight of between about 70,000-about 100,000, resulting in a viscosity of 45 and 55 cP at 4% solids and 20° C. It is also noted that polyvinyl alcohol-based foaming agents advantageously do not weaken paper-strength parameters by disrupting bonding between pulp fibers of the web. A combination of a nonionic, zwitterionic, or amphoteric foaming agent with a polyvinyl alcohol foaming agent (or its derivatives) at other molecular weights and degrees of hydrolysis also provided good foam qualities and good strength improvements in conjunction with cationic strength additives.

It was also observed that improved physical parameters in the samples were obtained when the foaming agents used had a hydrophilic-lipophilic balance (HLB) of above around 8. A HLB balance of above around 8 promotes the ability to produce foams in aqueous compositions.

It was also observed that synthetic strength additives having a cationic functional group and also containing primary amine functional units, in the form of polyvinylamine polymer units, were effective in improving strength parameters as compared to synthetic strength additives which did not contain primary amine functional units. In an exemplary embodiment, the synthetic strength additive having a cationic functional group included in the foaming formulation has a primary amine functionality of between about 1% and about 100%.

The foam assisted application of certain types of strength additives to different types of substrate will now be described in more detail below.

Virgin Liner Board

Virgin linerboard is linerboard that is produced using furnish from virgin bleached or unbleached pulp or a combination of the two (i.e., pulp that has not been made into paper or paperboard products and put into service as such). Virgin pulp is sometimes called "never-dried" pulp if it is produced on the site where the paper or paperboard is manufactured. It may also be produced from baled market pulp, which has been formed into rough pulp sheets and dried to 50%-80% solids for convenience of shipping and storage, when the pulp is produced remote from the location where the virgin linerboard is to be manufactured. Virgin linerboard may, for example, be used for producing corrugated boards and boxes, including white face boxes.

Due to its use in producing corrugated boxes, the strength and other structural properties of virgin linerboard are of utmost importance. However, the improvement of strength and other structural properties in virgin linerboard by the addition of strength additives in the thick stock portion of the stock prep system or in the wet end of the paper machine is often limited due to the interference caused by organic and inorganic contaminants carried over from the pulping process. This is typically due to less than perfect washing in the brown stock washing system or in the bleach plant, in the case of bleached virgin pulp, or both. In order to achieve the desired bonding strength properties of the final virgin linerboard, paper manufacturers may increase the basis weight of the linerboard. However, this approach has the disadvantage that the productivity of the paper machine is correspondingly reduced in relation to the increase in basis weight of the linerboard. The cost of the product linerboard per unit area may become prohibitively expensive when the basis weight is increased to meet strength specifications.

With the foam assisted application of synthetic cationic strength additives, an increase or an improvement in the bonding-related strength properties of the linerboard may be achieved beyond that available with wet-end addition of the same synthetic cationic strength additives.

Example results obtained with virgin linerboard substrates are set out below in Examples 2A to 2H.

Recycled Linerboard

Recycled linerboard is linerboard that is produced using pulp fibers reclaimed from previously manufactured and used, recycled paper and paperboard. Recycled linerboard may be used for producing corrugated boards and boxes, including white faced boxes. Recycled paperboard is also sometimes called test liner. Many paper mills, particularly in North America, produce linerboard from a blend of virgin pulp fibers and recycled pulp fibers.

Due to its use in producing corrugated boxes, the bonding-related strength and other structural properties of recycled linerboard are of utmost importance. However, the improvement of strength and other structural properties of recycled linerboard by the wet-end addition of strength additives (in the thick stock portion of the stock preparation system, or in the paper machine wet end) is often limited due to the interference caused by contaminating substances, which may include organic material such as lignin carried over from the pulping process when the original virgin linerboard was made, as well as accumulated additives from previous papermaking cycles. In particular, it was observed that recycled linerboard systems which use relatively little fresh water (sometimes called "closed" water systems) tend to suffer from a build-up of inorganic and/or organic contaminants such as lignin and additives added in the wet end from previous papermaking cycles. These contaminants negatively affect the ability of strength additives to perform when introduced into the pulp stock via wet-end addition (in the thick stock portion of the stock preparation system, or in the paper machine wet end). The typically anionic charged accumulated material, sometimes called "anionic trash," is thought to take up some of the typically cationic-charged strength additives, such that the cationic-charged strength additives are less effective because these strength additives are not completely associated with the fibers. In order to achieve the desired physical properties of the final recycled linerboard, paper manufacturers might opt to increase the basis weight of the linerboard. However, this approach has the disadvantage that the productivity of the paper machine is correspondingly reduced in relation to the increase in basis weight, and also results in the paper mill selling more expensive fiber per unit area of product, at greatly increased cost.

With the foam assisted application of cationic strength additives, a corresponding increase or an improvement in the strength properties of the linerboard may be achieved without a corresponding increase in the basis weight of the linerboard as compared to wet-end addition of the same cationic strength additives.

Example results obtained with recycled linerboard substrates are set out below in Examples 1A to 1F. It is also noted that the foam assisted application of synthetic strength additives comprising a cationic functional group has been observed to produce improved results in bag or sack paper products.

EXAMPLES

Example 1A

Handsheets of about 100 grams per square meter ("gsm") were produced using 500 Canadian standard freeness (CSF) recycled linerboard (RLB) pulp to test the strength improvements for foam additive addition of synthetic strength additives as compared to a control sheet. The wet formed webs were produced using Noble and Wood handsheet equipment and using standard procedures. There was no white water recycle used in the production of the handsheets. The formed wet sheets were then transferred to a foam application device that allowed for the application of a vacuum to the wet sheets. Foams were prepared using solutions of 2%-10% of a synthetic cationic strength additive (commercially available as Solenis LLC dry strength additive Hercobond™ 7700 (the percentage values being the weight percent of product in the foaming formulation). Several foams were formed using air as the gas in the presence of various foaming agents, including Macat® AO-12, Triton™ BG-10, and a polyvinyl alcohol-based foaming agent (commercially available as Selvol™ 540), and the anionic foaming agent sodium dodecyl sulfate (SDS), prior to applying the foamed formulations onto the wet formed sheets. The foaming agent concentrations were adjusted relative to the Hercobond™ 7700 concentration amounts in order to keep the foam's air content constant at a target air content of around 70%. The dosages of the foaming agents were between 2-15 g/L. The foams were formed by mixing the foaming agent and strength aid at desired concentrations into water. 25 g batches in 250 mL plastic beakers were created—one for each sheet—and mixed until fully dissolved. Then a hand-held electric homogenizer with a rotor/stator tip was used for about 30 seconds at 10000 RPM to generate the foam. The foams were applied to the sheet within 15 seconds of stopping the mixing.

Figure 3:
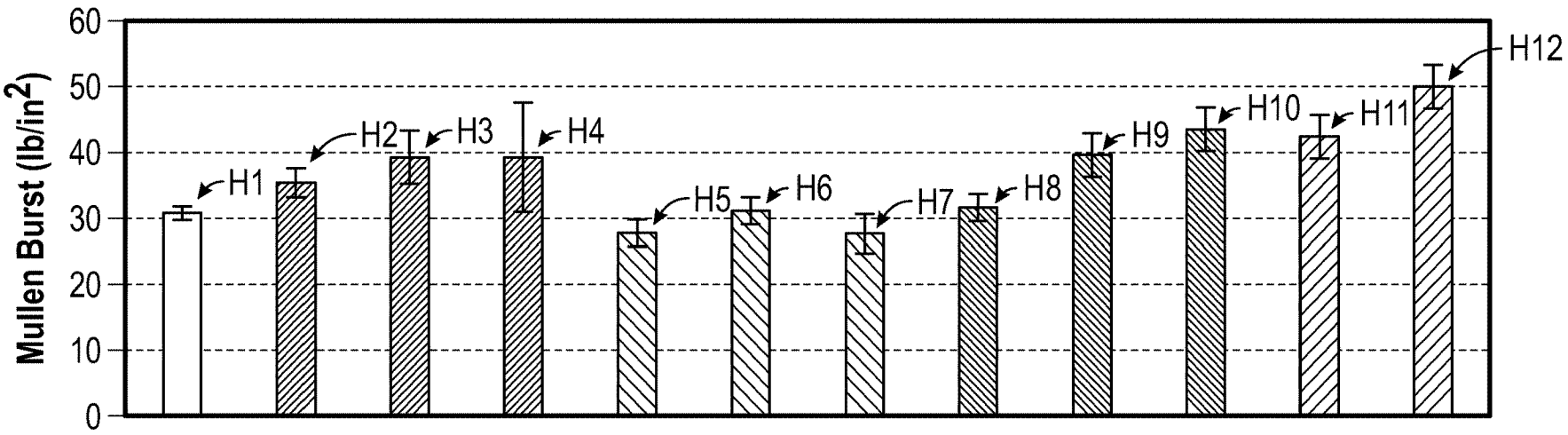
FIG. 3 shows a graph of dry Mullen Burst results on recycled linerboard samples.

The foams were applied to the wet formed webs using a draw down device. The handsheets evaluated in FIG. 3 are described below in Table I.

TABLE I

| Handsheet | Foaming Agent Utilized | Charge of Foaming Agent | Amount of Synthetic Strength Additive I |
|---|---|---|---|
| Handsheet 1 (Comparative) | — | — | — |
| Handsheet 2 (Exemplary) | Exemplary Foaming Agent I | Amphoteric | 2 wt. % |
| Handsheet 3 (Exemplary) | Exemplary Foaming Agent I | Amphoteric | 5 wt. % |
| Handsheet 4 (Exemplary) | Exemplary Foaming Agent I | Amphoteric | 10 wt. % |
| Handsheet 5 (Comparative) | Comparative Foaming Agent I | Anionic | 2 wt. % |
| Handsheet 6 (Comparative) | Comparative Foaming Agent I | Anionic | 5 wt. % |
| Handsheet 7 (Comparative) | Comparative Foaming Agent I | Anionic | 10 wt. % |
| Handsheet 8 (Exemplary) | Exemplary Foaming Agent II | Non-ionic | 2 wt. % |
| Handsheet 9 (Exemplary) | Exemplary Foaming Agent II | Non-ionic | 5 wt. % |
| Handsheet 10 (Exemplary) | Exemplary Foaming Agent II | Non-ionic | 10 wt. % |
| Handsheet 11 (Exemplary) | Exemplary Foaming Agent III | Non-ionic | 2 wt. % |
| Handsheet 12 (Exemplary) | Exemplary Foaming Agent III | Non-ionic | 10 wt. % |

Exemplary Foaming Agent I includes an amine oxide which is amphoteric and commercially available from Pilot Chemical under the trade name Macat® AO-12.

Exemplary Foaming Agent II includes an alkyl polyglucoside which is non-ionic and commercially available from Dow Chemical under the trade name Triton™ BG-10.

Exemplary Foaming Agent III includes a polyvinyl alcohol which is non-ionic and commercially available from Solenis LLC of Wilmington, Del., under the trade name DeTac™ and from Sekisui Specialty Chemicals of Dallas, Tex., under the trade name Selvol™ 540.

Comparative Foaming Agent I includes sodium dodecyl sulfate which is anionic and commercially available from various sources.

Synthetic Strength Additive I includes a graft copolymer of a vinyl monomer and functionalized vinyl amine which is cationic and commercially available from Solenis LLC of Wilmington, Del., under the trade name Hercobond™ 7700.

The bursting strength of the resulting samples were then tested using the Mullen Burst test. The results are shown in FIG. 3. By setting the height of foam applied to the sheet, it was estimated that a 1% Hercobond™ 7700 foamed solution is equivalent to applying 4-5 lb./ton of Hercobond™ 7700 to the sheet via wet-end addition. This was subsequently confirmed by calibration experiments in which the nitrogen content of known amounts of applied strength additives were determined and the actual content of synthetic strength additive in the sheet was calculated.

As can be seen in FIG. 3, the foam-assisted application of Hercobond™ 7700 had a clear effect on bursting strength as compared to the control sheet. In particular, it was observed that the foam assisted application of Hercobond™ 7700 with the Macat® AO-12 foaming agent, with the Triton™ BG-10 foaming agent, and with the Selvol™ 540 foaming agent, the bursting strength of the paper samples increased as compared to the untreated control sheet.

As can also be seen in FIG. 3, it was observed that the use of the anionic surfactant sodium dodecyl sulfate (SDS) foaming agent resulted in at best a negligible increase in bursting strength, and at worst a decrease in bursting strength, as compared to the control. As explained above, without being bound by theory, it is suspected that the use of SDS results in a deterioration of strength properties in the sheet sample due to increased electrostatic and hydrophobic interactions between SDS and the pulp fibers of the wet sheets. These increased electrostatic and hydrophobic interactions are believed to interrupt pulp fiber bonding and interfere with the action of strength additives.

As such, it was observed that the use of amphoteric, nonionic and/or polymeric foaming agents provided good foamability and stability properties and had minimal interference with the cationic strength additive, and therefore led to an improvement in the bonding-related strength properties of the samples, whilst the use of the anionic foaming agent SDS was less successful in improving the strength properties of the samples. In particular, it is observed that dimethylamine oxide-based amphoteric surfactants, alkyl polyglucosides-based surfactants, and polyvinyl alcohol-based surfactants all lead to an improvement in the strength properties of the samples.

As can also be seen in FIG. 3, the largest increase in bursting strength was achieved using Selvol™ 540. It was observed that polyvinyl alcohol-based foaming agents exhibit a synergistic effect with strength additives in terms of strength improvement properties.

As can also be seen in FIG. 3, for each of the Macat® AO-12 foaming agent, the Triton™ BG-10 foaming agent, and the Selvol™ 540 foaming agent, the bursting strength improvement advantageously increased with respect to an increase in the concentration of Hercobond™ 7700.

Example 1B

Figure 4:
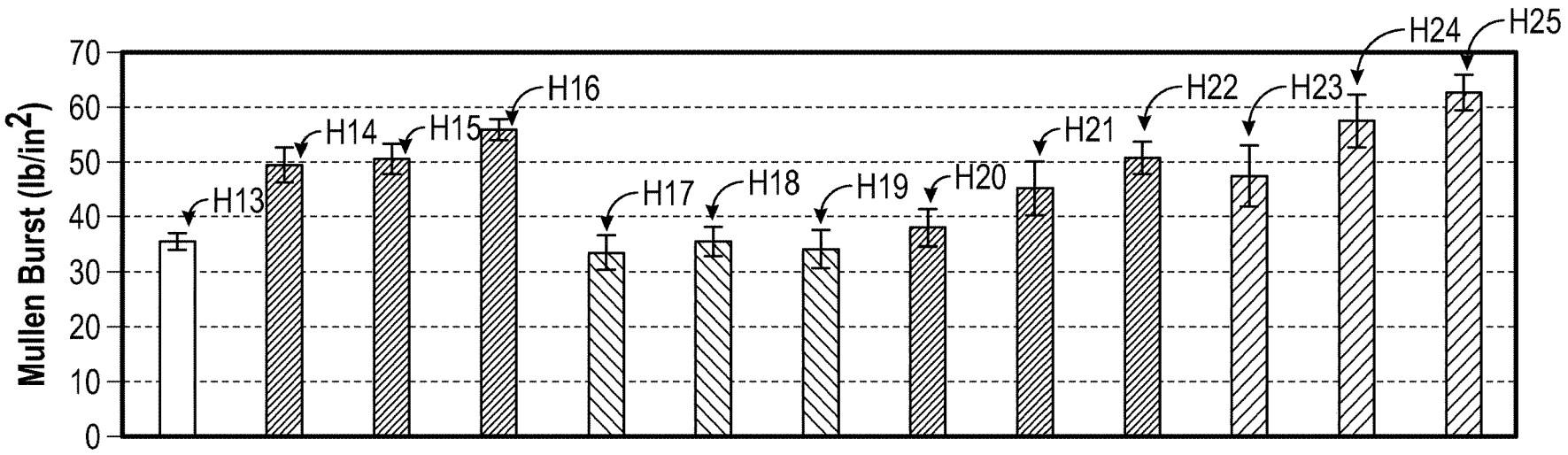
FIG. 4 shows another graph of dry Mullen Burst results on recycled linerboard samples.

To confirm the results in Example 1A, the same experimental trial was performed using handsheets that were produced using 340 Canadian standard freeness (CSF) recycled linerboard pulp. Foams were prepared in accordance with the foam formation described in Example 1A. The results of Example 1B are shown in FIG. 4. The handsheets evaluated in FIG. 4 are described below in Table II.

TABLE II

| Handsheet | Foaming Agent Utilized | Charge of Foaming Agent | Amount of Synthetic Strength Additive I |
|---|---|---|---|
| Handsheet 13 (Comparative) | — | — | — |
| Handsheet 14 (Exemplary) | Exemplary Foaming Agent I | Amphoteric | 2 wt. % |
| Handsheet 15 (Exemplary) | Exemplary Foaming Agent I | Amphoteric | 5 wt. % |
| Handsheet 16 (Exemplary) | Exemplary Foaming Agent I | Amphoteric | 10 wt. % |
| Handsheet 17 (Comparative) | Comparative Foaming Agent I | Anionic | 2 wt. % |
| Handsheet 18 (Comparative) | Comparative Foaming Agent I | Anionic | 5 wt. % |
| Handsheet 19 (Comparative) | Comparative Foaming Agent I | Anionic | 10 wt. % |
| Handsheet 20 (Exemplary) | Exemplary Foaming Agent II | Non-ionic | 2 wt. % |
| Handsheet 21 (Exemplary) | Exemplary Foaming Agent II | Non-ionic | 5 wt. % |
| Handsheet 22 (Exemplary) | Exemplary Foaming Agent II | Non-ionic | 10 wt. % |
| Handsheet 23 (Exemplary) | Exemplary Foaming Agent III | Non-ionic | 2 wt. % |
| Handsheet 24 (Exemplary) | Exemplary Foaming Agent III | Non-ionic | 5 wt. % |
| Handsheet 25 (Exemplary) | Exemplary Foaming Agent III | Non-ionic | 10 wt. % |

Exemplary Foaming Agent I includes an amine oxide which is amphoteric and commercially available from Pilot Chemical under the trade name Macat® AO-12.

Exemplary Foaming Agent II includes an alkyl polyglucoside which is non-ionic and commercially available from Dow Chemical under the trade name Triton™ BG-10.

Exemplary Foaming Agent III includes a polyvinyl alcohol which is non-ionic and commercially available from Solenis LLC of Wilmington, Del., under the trade name DeTac™ and from Sekisui Specialty Chemicals of Dallas, Tex., under the trade name Selvol™ 540.

Comparative Foaming Agent I includes sodium dodecyl sulfate which is anionic and commercially available from various sources.

Synthetic Strength Additive I includes a graft copolymer of a vinyl monomer and functionalized vinyl amine which is cationic and commercially available from Solenis LLC of Wilmington, Del., under the trade name Hercobond™ 7700.

As can be seen in FIG. 4, the foam-assisted application of Hercobond™ 7700 had a clear effect on the bursting strength in the 340 CSF handsheets. In particular, it was observed that, similar to Example 1A, for the application of Hercobond™ 7700 with the Macat® AO-12 foaming agent, with the Triton™ BG-10 foaming agent, and with the Selvol™ 540 foaming agent, the bursting strength of the sheet samples increased as compared to the untreated control sheet.

As such, Example 1B confirms that the improvements associated with foam assisted application are applicable across a variety of furnish conditions.

Example 1C

Figure 5:
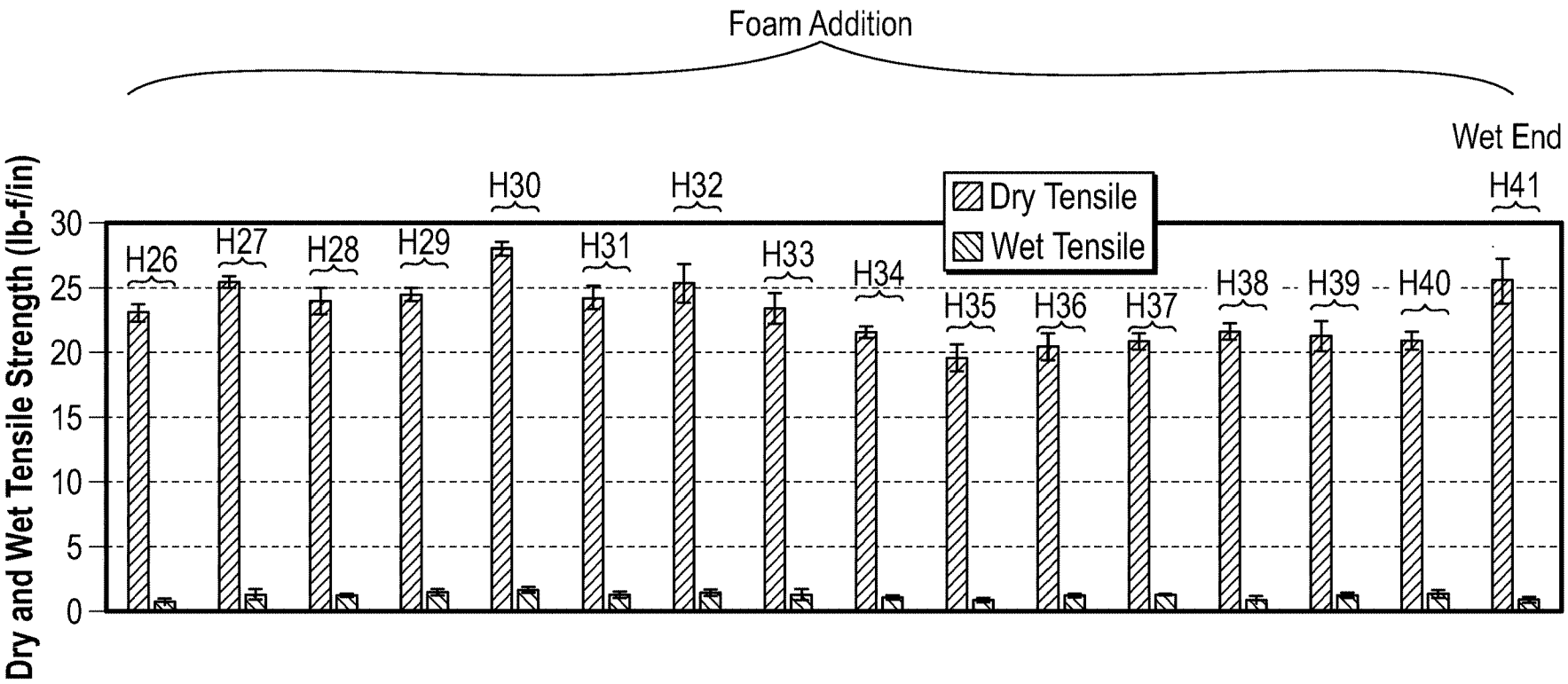
FIG. 5 shows a graph of dry and wet tensile strength results on recycled linerboard samples.

Handsheets of about 100 gsm were produced using recycled linerboard pulp using handsheets that were produced using 370 CSF recycled linerboard pulp. The wet formed sheets were produced using Noble and Wood handsheet equipment using standard procedures and with no white water recycle. Foams prepared using a 1% cationic synthetic strength additive (commercially available as Hercobond™ 7700), as product weight in a foaming formulation, were formed with various foaming agents prior to applying onto a wet formed sheet. The foaming agents used in this example include Triton™ BG-10, Glucopon® 425N, Crodateric™ CAS 50, Selvol™ 540, Multitrope™ 1620, Macat® AO-12, NatSurf™ 265, Triton™ X-100, Mona™ AT-1200, Tween® 80, Tween® 20, Crodasinic™ LS30, Diversaclean™, and Forestall™. The foams were prepared in accordance with the foam formation described in Example 1A. The dry and wet (rewetted) tensile strengths of each of the foaming agents were then tested and compared to the dry and wet (rewetted) tensile strengths of an untreated control sheet and also to a sample sheet in which Hercobond™ 7700 was added at 4 lbs/ton via wet-end addition. The results of Example 1C are shown in FIG. 5. The handsheets evaluated in FIG. 5 are described below in Table III.

TABLE III

| Hand sheets | Foaming Agent Utilized | Charge of Foaming Agent | Amount of Synthetic Strength Additive I |
|---|---|---|---|
| Handsheet 26 (Comparative) | — | — | — |
| Handsheet 27 (Exemplary) | Exemplary Foaming Agent II | Non-ionic | 1 wt. % |
| Handsheet 28 (Exemplary) | Exemplary Foaming Agent IV | Non-ionic | 1 wt. % |
| Handsheet 29 (Exemplary) | Exemplary Foaming Agent V | Zwitterionic | 1 wt. % |
| Handsheet 30 (Exemplary) | Exemplary Foaming Agent III | Non-ionic | 1 wt. % |
| Handsheet 31 (Exemplary) | Exemplary Foaming Agent VI | Non-ionic | 1 wt. % |
| Handsheet 32 (Exemplary) | Exemplary Foaming Agent I | Amphoteric | 1 wt. % |
| Handsheet 33 (Exemplary) | Exemplary Foaming Agent VII | Non-ionic | 1 wt. % |
| Handsheet 34 (Exemplary) | Exemplary Foaming Agent VIII | Non-ionic | 1 wt. % |
| Handsheet 35 (Exemplary) | Exemplary Foaming Agent IX | Zwitterionic | 1 wt. % |
| Handsheet 36 (Exemplary) | Exemplary Foaming Agent X | Non-ionic | 1 wt. % |
| Handsheet 37 (Exemplary) | Exemplary Foaming Agent XI | Non-ionic | 1 wt. % |
| Handsheet 38 (Comparative) | Comparative Foaming Agent II | Anionic | 1 wt. % |
| Handsheet 39 (Exemplary) | Exemplary Foaming Agent XII | Non-ionic | 1 wt. % |
| Handsheet 40 (Exemplary) | Exemplary Foaming Agent XIII | Cationic | 1 wt. % |
| Handsheet 41 (Comparative) | — | — | 4 lbs/ton (Wet-end addition) |

Exemplary Foaming Agent I includes an amine oxide which is amphoteric and commercially available from Pilot Chemical under the trade name Macat® AO-12.

Exemplary Foaming Agent II includes an alkyl polyglucoside which is non-ionic and commercially available from Dow Chemical under the trade name Triton™ BG-10.

Exemplary Foaming Agent III includes a polyvinyl alcohol which is non-ionic and commercially available from Solenis LLC of Wilmington, Del., under the trade name DeTac™ and from Sekisui Specialty Chemicals of Dallas, Tex., under the trade name Selvol™ 540.

Exemplary Foaming Agent IV includes an alkyl polyglucoside which is non-ionic and commercially available from BASF under the trade name Glucopon® 425N.

Exemplary Foaming Agent V includes a cocamidopropyl hydroxysultaine which is zwitterionic and commercially available from Croda under the trade name Crodateric™ CAS 50.

Exemplary Foaming Agent VI includes a polysaccharide which is non-ionic and commercially available from Croda under the trade name Multitrope™ 1620.

Exemplary Foaming Agent VII includes an ethoxylated alcohol which is non-ionic and commercially available from Croda under the trade name NatSurf™ 265.

Exemplary Foaming Agent VIII includes a polyethylene glycol which is non-ionic and commercially available from Dow Chemical under the trade name Triton™ X-100.

Exemplary Foaming Agent IX includes a betaine which is zwitterionic and commercially available from Croda under the trade name Mona™ AT-1200.

Exemplary Foaming Agent X includes a hexitol ester which is non-ionic and commercially available from Croda under the trade name Tween® 80.

Exemplary Foaming Agent XI includes a hexitol ester which is non-ionic and commercially available from Croda under the trade name Tween® 20.

Exemplary Foaming Agent XII includes a mixture of an alkyl polyglucoside and an alkoxylated alcohol which are non-ionic and commercially available from Croda under the trade name Diversaclean™.

Exemplary Foaming Agent XIII includes an alkyl quaternary ammonium which is cationic and commercially available from Croda under the trade name Forestall™.

Comparative Foaming Agent II includes a lauroyl sarcosinate which is anionic and commercially available from Croda under the trade name Crodasinic™ LS30.

Synthetic Strength Additive I includes a graft copolymer of a vinyl monomer and functionalized vinyl amine which is cationic and commercially available from Solenis LLC of Wilmington, Del., under the trade name Hercobond™ 7700.

As can be seen in FIG. 5, the choice of foaming agent has an effect on both dry and wet (rewetted) tensile strength of the handsheet. All the foams that were applied to the handsheets contained the same amount of synthetic cationic strength additive Hercobond™ 7700. Some foaming agents (such as Tween® 80 and Tween® 20) reduced the dry tensile strength of the handsheet to below that of the control sheet, while others (such as Selvol™ 540) improved the dry tensile strength to a level greater than that of the wet end addition sample.

It is observed in FIG. 5 that the wet-end addition of 4 lbs/ton Hercobond™ 7700 resulted in a higher dry tensile strength as compared to the foam assisted application of Hercobond™ 7700 with most of the foaming agents. It is believed that since the handsheets used in this example were prepared with no white water recycle, the pollutants (such as lignin) that would otherwise reduce the effectiveness of the wet-addition of strength additives were likely not present in an amount that would normally be expected in industrial applications. As such, it is likely that the tensile strength increase shown through wet-end addition in this example is higher than what could actually be realized in industrial applications, where white water recycling is used.

In any case, the results shown in FIG. 5 demonstrate that there are clear dry tensile strength improvements associated with foam assisted addition of strength additives.

Still further, FIG. 5 also shows that the foam assisted addition of strength additives improves the wet (rewetted) tensile strength of the handsheets as compared to the control. Furthermore, the majority of foaming agents used in the foam assisted application of Hercobond™ 7700 resulted in an improvement of wet (rewetted) tensile strength as compared to the wet-end addition of Hercobond™ 7700.

Example 1D

Figure 6:
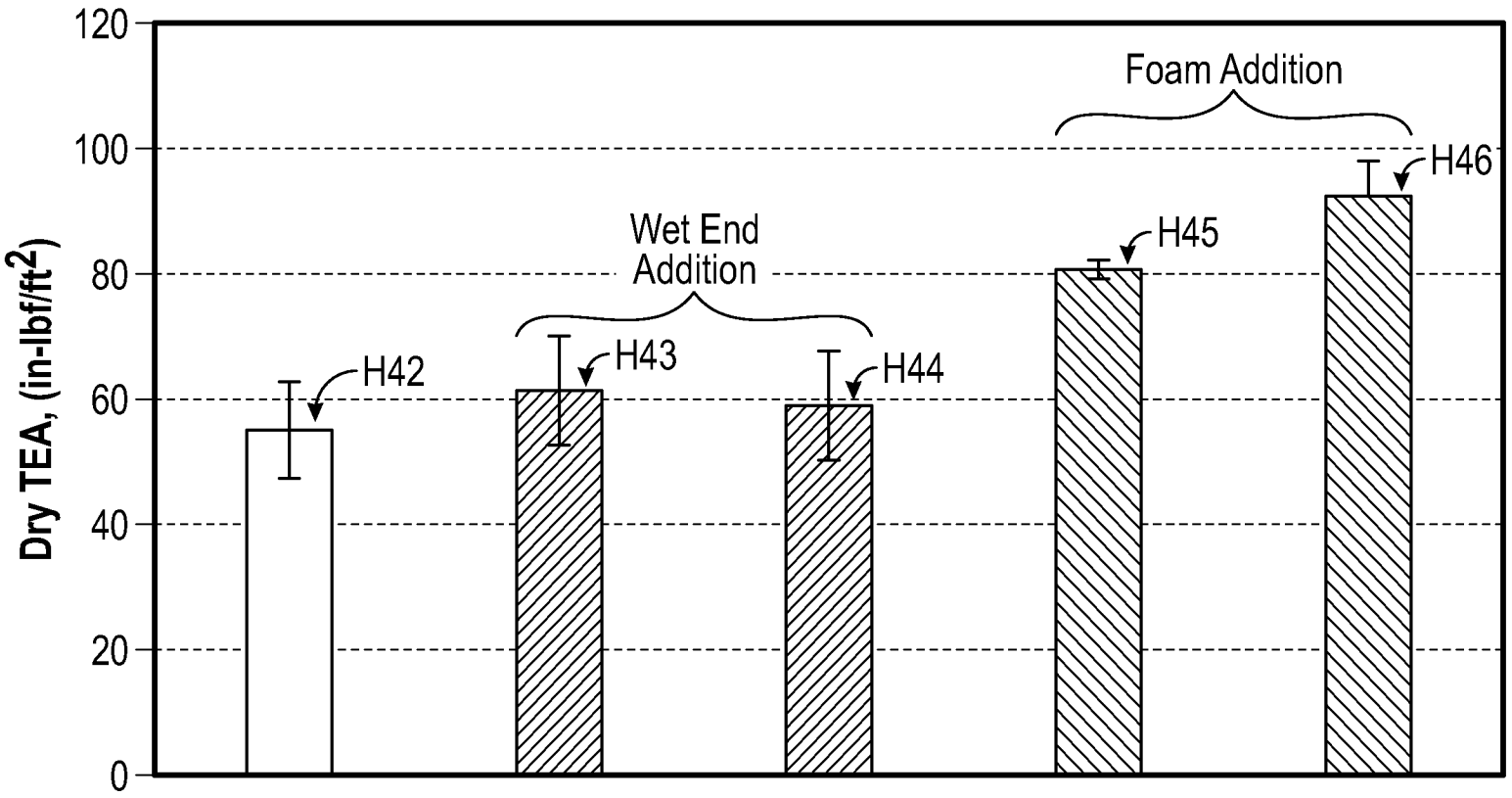
FIG. 6 shows a graph of tensile energy absorption results on recycled linerboard samples.

Handsheets of about 100 gsm were produced using recycled linerboard using 370 CSF recycled linerboard pulp and using the same equipment and procedures described in the previous examples. A synthetic cationic strength additive (commercially available as Hercobond™ 7700) was applied to the sheets using the foaming agent Selvol™ 540. Foams were prepared in accordance with the foam formation described in Example 1A. The dry tensile energy absorption (TEA) of the handsheets was then tested. The results are shown in FIG. 6. The handsheets evaluated in FIG. 6 are described below in Table IV.

TABLE IV

| Handsheets | Foaming Agent Utilized | Charge of Foaming Agent | Amount of Synthetic Strength Additive I |
|---|---|---|---|
| Handsheet 42 (Comparative) | — | — | — |
| Handsheet 43 (Comparative) | — | — | 1 lb/ton (Wet-end addition) |
| Handsheet 44 (Comparative) | — | — | 2 lbs/ton (Wet-end addition) |
| Handsheet 45 (Exemplary) | Exemplary Foaming Agent III | Non-ionic | 1 wt. % |
| Handsheet 46 (Exemplary) | Exemplary Foaming Agent III | Non-ionic | 2 wt. % |

Exemplary Foaming Agent III includes a polyvinyl alcohol which is non-ionic and commercially available from Solenis LLC of Wilmington, Del., under the trade name DeTac™ and from Sekisui Specialty Chemicals of Dallas, Tex., under the trade name Selvol™ 540.

Synthetic Strength Additive I includes a graft copolymer of a vinyl monomer and functionalized vinyl amine which is cationic and commercially available from Solenis LLC of Wilmington, Del., under the trade name Hercobond™ 7700.

As shown in FIG. 6, an improvement in dry TEA is observed when adding Hercobond™ 7700 via foam assisted addition as compared to with wet end addition. As can be seen in FIG. 6, a dosage response in dry TEA is observed with foam assisted addition of Hercobond™ 7700, whilst no dosage response in dry TEA was observed for wet-end addition. In addition, a significant improvement of almost 70% over the control sheet was observed through the use of foam addition with 2% of Hercobond™ 7700 in the foaming solution. The improvement in dry TEA seen from the 2 lbs/ton of Hercobond™ 7700 via wet end addition was very small.

Example 1E

Figure 7:
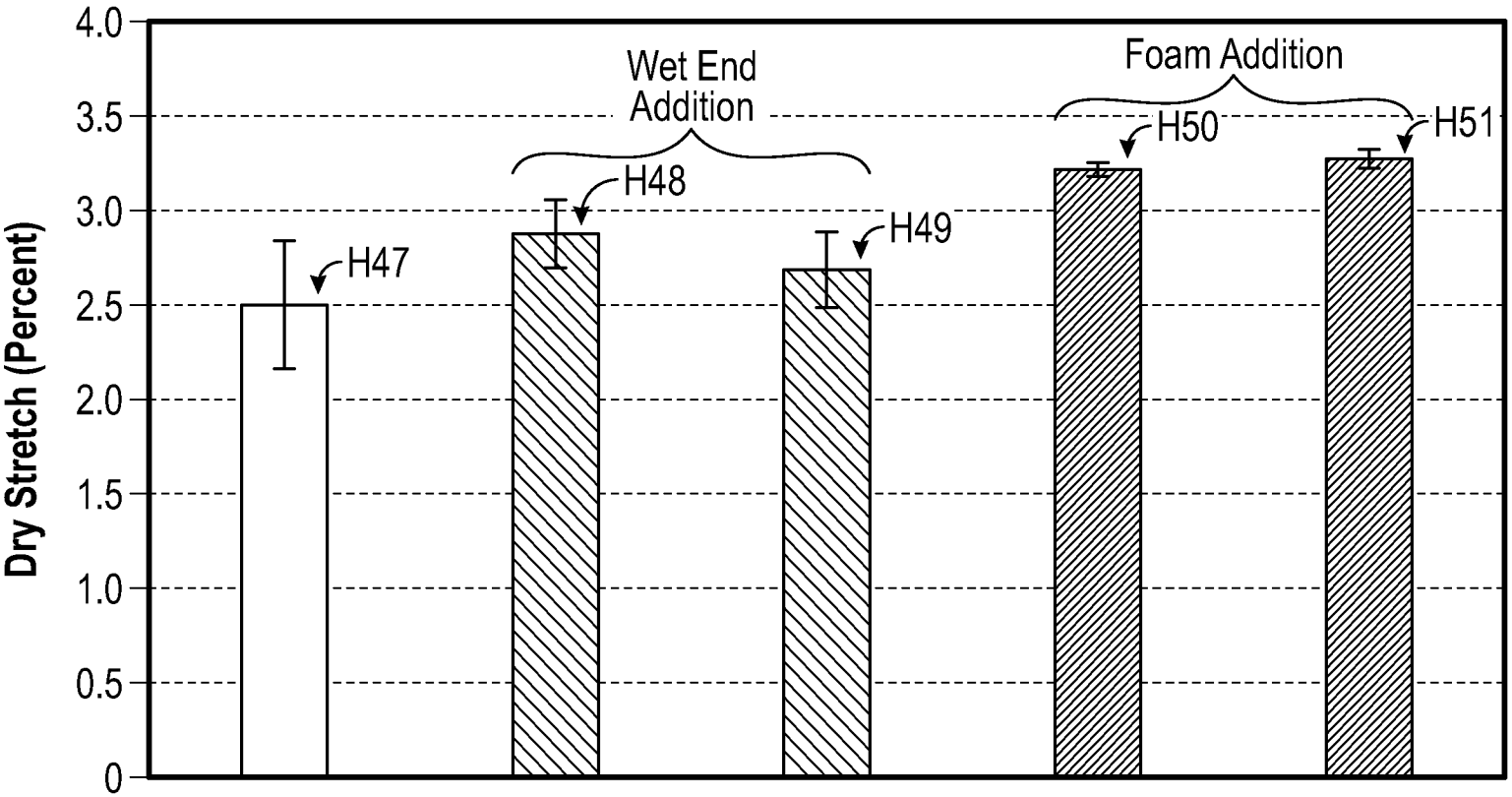
FIG. 7 shows a graph of dry stretch results on recycled linerboard samples.

Handsheets produced in the same manner as for Example 1D were tested for dry stretch percentage. The foams were prepared in accordance with the foam formation described in Example 1A. The results are shown in FIG. 7. The handsheets evaluated in FIG. 7 are described below in Table V.

TABLE V

| Handsheets | Foaming Agent Utilized | Charge of Foaming Agent | Amount of Synthetic Strength Additive I |
|---|---|---|---|
| Handsheet 47 (Comparative) | — | — | — |
| Handsheet 48 (Comparative) | — | — | 1 lb/ton (Wet-end addition) |
| Handsheet 49 (Comparative) | — | — | 2 lbs/ton (Wet-end addition) |
| Handsheet 50 (Exemplary) | Exemplary Foaming Agent III | Non-ionic | 1 wt. % |
| Handsheet 51 (Exemplary) | Exemplary Foaming Agent III | Non-ionic | 2 wt. % |

Exemplary Foaming Agent III includes a polyvinyl alcohol which is non-ionic and commercially available from Solenis LLC of Wilmington, Del., under the trade name DeTac™ and from Sekisui Specialty Chemicals of Dallas, Tex., under the trade name Selvol™ 540.

Synthetic Strength Additive I includes a graft copolymer of a vinyl monomer and functionalized vinyl amine which is cationic and commercially available from Solenis LLC of Wilmington, Del., under the trade name Hercobond™ 7700.

As shown in FIG. 7, an improvement in dry stretch is observed when adding Hercobond™ 7700 via foam assisted addition as compared to with wet end addition. As can also be seen in FIG. 7, a small dosage response in dry stretch was observed with foam assisted addition of Hercobond™ 7700, whilst no dosage response in dry stretch was observed for wet-end addition. In particular, the wet-end addition of Hercobond™ 7700 showed an improvement of about 10% over the control, while the foam assisted addition of Hercobond™ 7700 increased the dry stretch of the handsheet by about 30%.

Examples 1D and 1E demonstrate that, for applications which require good stretch and TEA properties, which are properties traditionally associated with the production of Kraft bag or sack paper, the foam assisted addition of strength additive results in an improvement over the wet end addition of the same strength additives.

Example 1F

Figure 8:
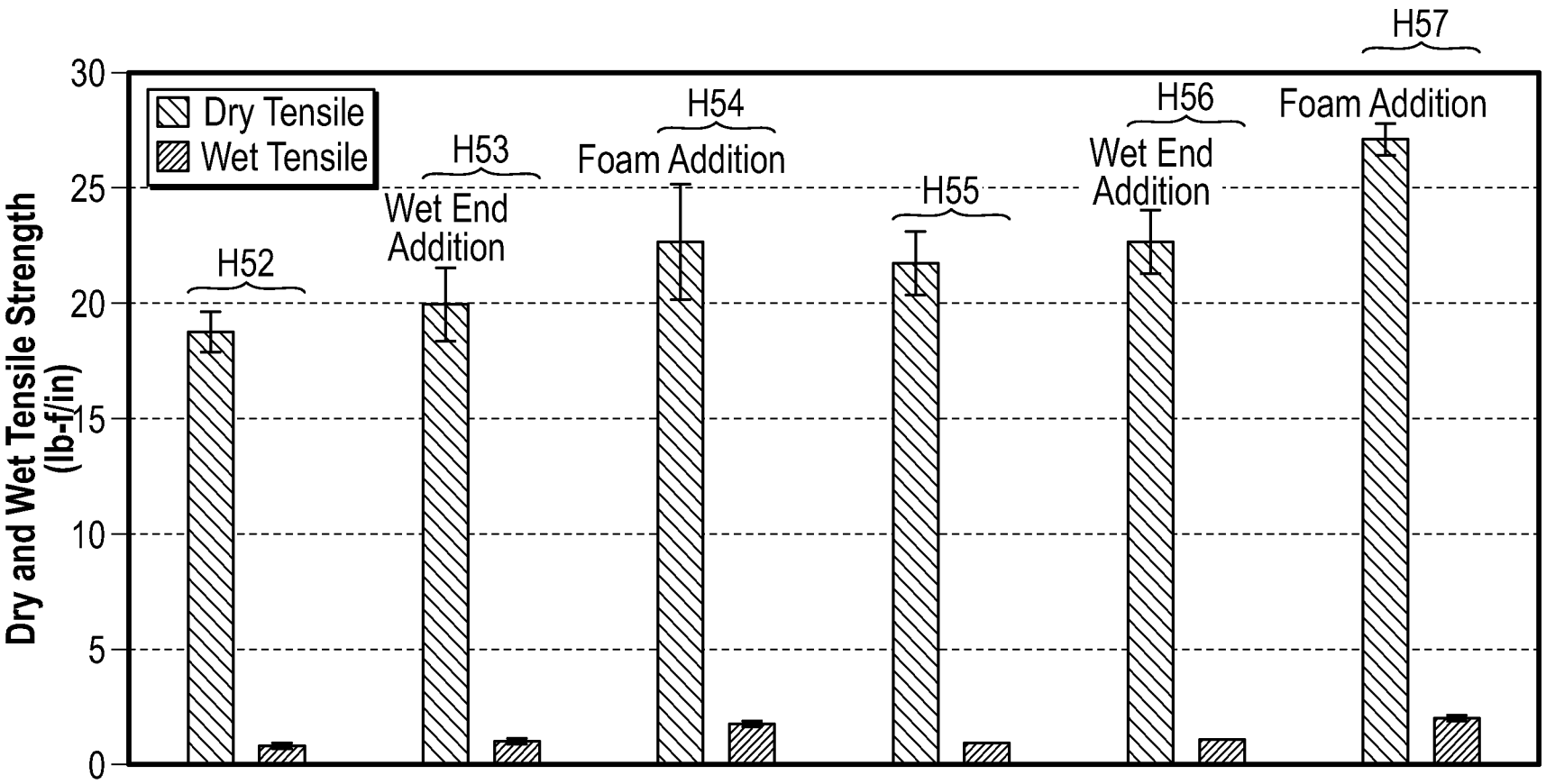
FIG. 8 shows a graph of dry and wet tensile strength results on recycled linerboard samples.

Handsheets of about 100 gsm using 370 CSF "clean" recycled linerboard pulp were produced using the same equipment and procedures described above with respect to Example 1E. A control sheet and a sheet with 5 lbs/ton. of a synthetic cationic strength additive (available commercially as Hercobond™ 7700), added via wet-end addition, were first made. Next, soluble lignin, a common contaminant that can build up in closed recycled linerboard water systems, was dissolved into the wet end at a level of 18 lbs/ton as an approximate simulation of organic pollutants in industrial conditions. Using this "dirty" pulp, the two handsheets were duplicated. A third handsheet was produced using the same method and was then treated with a 1% Hercobond™ 7700 foam using Selvol™ 540 as the foaming agent. The foams were prepared in accordance with the foam formation described in Example 1A. The dry and wet tensile strength of each handsheet was then tested. The results of the tensile testing are shown in FIG. 8. The handsheets evaluated in FIG. 8 are described below in Table VI.

TABLE VI

| Handsheets | Pulp Quality | Foaming Agent Utilized | Charge of Foaming Agent | Amount of Synthetic Strength Additive I |
|---|---|---|---|---|
| Handsheet 52 (Comparative) | "Clean" | — | — | — |
| Handsheet 53 (Comparative) | "Clean" | — | — | 5 lbs/ton (Wet-end addition) |
| Handsheet 54 (Exemplary) | "Clean" | Exemplary Foaming Agent III | Non-ionic | 1 wt. % |
| Handsheet 55 (Comparative) | "Dirty" | — | — | — |
| Handsheet 56 (Comparative) | "Dirty" | — | — | 5 lbs/ton (Wet-end addition) |
| Handsheet 57 (Exemplary) | "Dirty" | Exemplary Foaming Agent III | Non-ionic | 1 wt. % |

Exemplary Foaming Agent III includes a polyvinyl alcohol which is non-ionic and commercially available from Solenis LLC of Wilmington, Del., under the trade name DeTac™ and from Sekisui Specialty Chemicals of Dallas, Tex., under the trade name Selvol™ 540.

Synthetic Strength Additive I includes a which is cationic and commercially available from Solenis LLC of Wilmington, Del., under the trade name Hercobond™ 7700.

The dry tensile of the handsheet prepared with the wet end addition of Hercobond™ 7700 and the "clean" recycled linerboard furnish showed an improvement of about 10% in dry tensile strength as compared to the control. However, the improvement with wet-end addition of Hercobond™ 7700 dropped to only about 5% over the control in the "dirty" recycled linerboard furnish. This result indicates that the soluble lignin contaminants decreases the effect of strength additives added by wet-end addition.

In the handsheets prepared with the foam assisted addition of strength additives, both the "clean" and "dirty" recycled linerboard furnish systems showed a large improvement in dry tensile strength as compared to wet-end addition. This was especially noticeable in the "dirty" system. As such, it is envisaged that the foam assisted addition of strength additives would be useful in recycled linerboard mills with highly closed water systems, since the build-up of soluble lignin does not negatively affect foam assisted addition as much as wet-end addition. In particular, since the foam is added to a pre-formed wet sheet, interference from wet end residual chemicals (such as soluble lignin) is reduced, thereby resulting in a higher effectiveness of the dry strength agent.

Example 2A

Handsheets of about 100 gsm were produced using never-dried unbleached virgin kraft slush pulp using 750 CSF virgin linerboard pulp to test for the strength improvements with the foam assisted addition of strength additives as compared to the wet-end addition of the same strength additives. The wet formed sheets were produced using Noble and Wood handsheet equipment under standard procedures and with no white water recycle. The wet formed sheets were then transferred to a foam application device that allowed for the application of a vacuum to the sheet. The amount of applied foam could be estimated by the height of foam applied to the sheet and was subsequently confirmed by calibration experiments monitoring the nitrogen content of known amounts of applied strength additives.

Foams were prepared using solutions of 1%-5% of a cationic strength additive (available commercially as Solenis LLC dry strength additive Hercobond™ 7700)—with the percentages being the weight of product in foaming formulation—a polyvinyl amine-containing strength additive in the presence of a foaming agent (Selvol™ 540). The foaming agent concentration was adjusted so that the foams had an air content of around 70%. As an example of such an adjustment, at 1% Hercobond™ 7700 concentration, a concentration of 0.6% Selvol™ 540 was used. These foams were then applied onto some of the wet formed sheets. Other handsheets were treated with wet-end addition of Hercobond™ 7700 at dosages of 1 to 4 lbs/ton. It is noted that foams prepared from 1% strength additive solution are approximately equivalent to the addition of about 4 lbs/ton of the wet end addition of strength additive solution, based on the retention characteristics of the strength additive.

Figure 9:
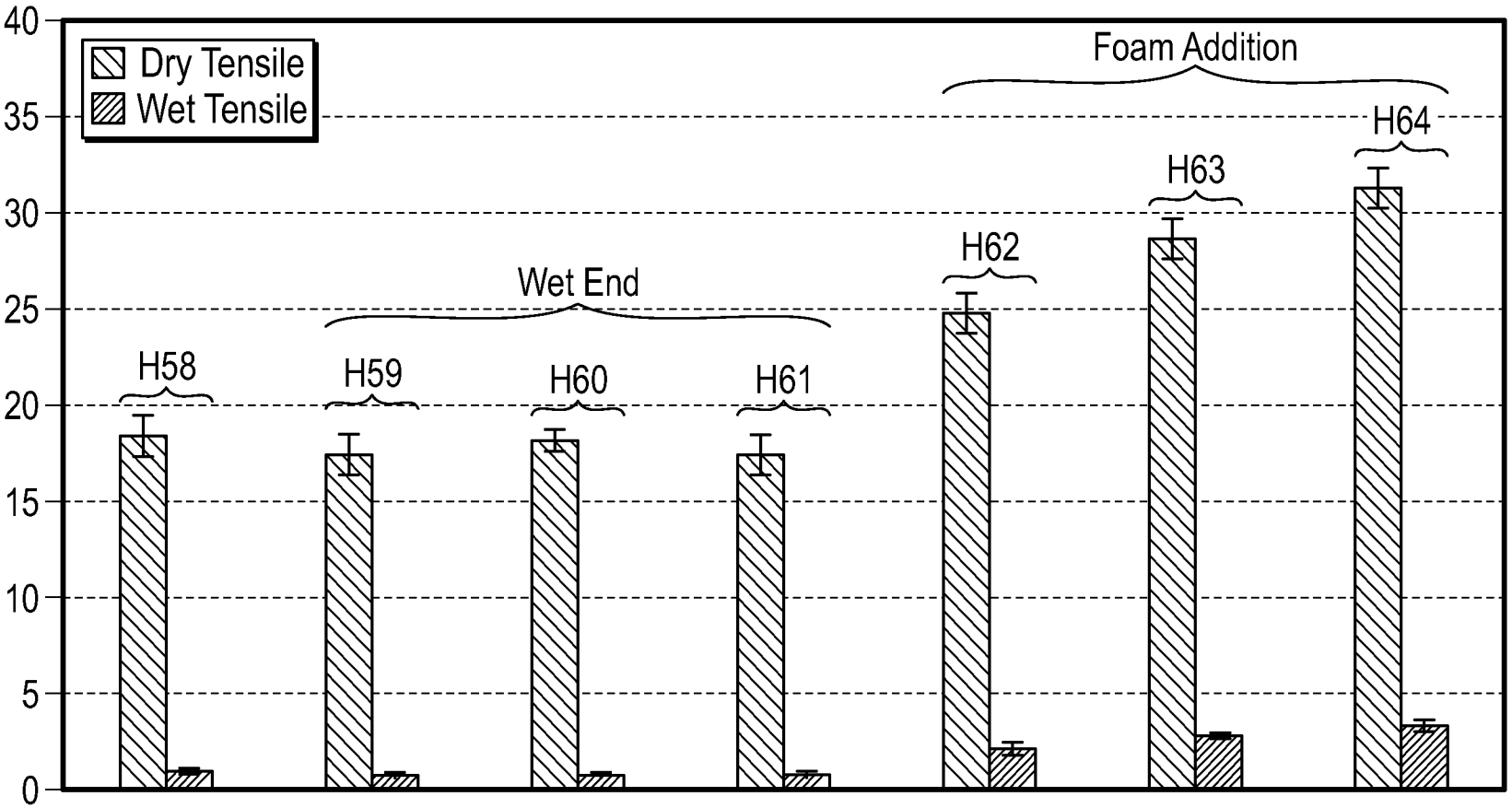
FIG. 9 shows a graph of dry and wet tensile strength results on virgin linerboard samples.

The dry and wet (rewetted) tensile strengths of the resulting samples were then tested. The results are shown in FIG. 9. The handsheets evaluated in FIG. 9 are described below in Table VII.

TABLE VII

| Handsheets | Foaming Agent Utilized | Charge of Foaming Agent | Amount of Synthetic Strength Additive I |
|---|---|---|---|
| Handsheet 58 (Comparative) | — | — | — |
| Handsheet 59 (Comparative) | — | — | 1 lb/ton (Wet-end addition) |
| Handsheet 60 (Comparative) | — | — | 2 lbs/ton (Wet-end addition) |
| Handsheet 61 (Comparative) | — | — | 4 lbs/ton (Wet-end addition) |
| Handsheet 62 (Exemplary) | Exemplary Foaming Agent III | Non-ionic | 1 wt. % |
| Handsheet 63 (Exemplary) | Exemplary Foaming Agent III | Non-ionic | 2 wt. % |
| Handsheet 64 (Exemplary) | Exemplary Foaming Agent III | Non-ionic | 5 wt. % |

Exemplary Foaming Agent III includes a polyvinyl alcohol which is non-ionic and commercially available from Solenis LLC of Wilmington, Del., under the trade name DeTac™ and from Sekisui Specialty Chemicals of Dallas, Tex., under the trade name Selvol™ 540.

Synthetic Strength Additive I includes a graft copolymer of a vinyl monomer and functionalized vinyl amine which is cationic and commercially available from Solenis LLC of Wilmington, Del., under the trade name Hercobond™ 7700.

As can be seen in FIG. 9, the foam-assisted application of Hercobond™ 7700 had a clear beneficial effect on both dry and wet (rewetted) tensile strength. In particular, it was observed that with the application of Hercobond™ 7700 with the Selvol™ 540 foaming agent, the dry and wet (rewetted) tensile strength of the samples increased as compared to the control and as compared to wet-end addition of Hercobond™ 7700.

As can also be seen in FIG. 9, the wet-end addition of the cationic strength additive tensile strength did not improve compared to the untreated control. Without being bound by theory, it is possible that the addition of the cationic strength additive was ineffective at improving tensile strength of the prepared samples due to interference from contaminants remaining in the pulp furnish from the pulping process. Since the foamed addition of Hercobond™ 7700 reduces the possibility of such interference by reducing the likelihood of interaction between the Hercobond™ 7700 and the interfering substances, the foam assisted addition of Hercobond™ 7700 was more effective at improving the wet and dry tensile strength of the samples.

It is also shown in FIG. 9 that the foam assisted application of Hercobond™ 7700 shows a so-called "dose response", i.e., that an increase in the concentration of Hercobond™ 7700 added to the sample resulted in a corresponding increase in both the dry and wet (rewetted) tensile strength of the samples. No such dose response was observed with the wet-end addition of Hercobond™ 7700.

Example 2B

Figure 10:
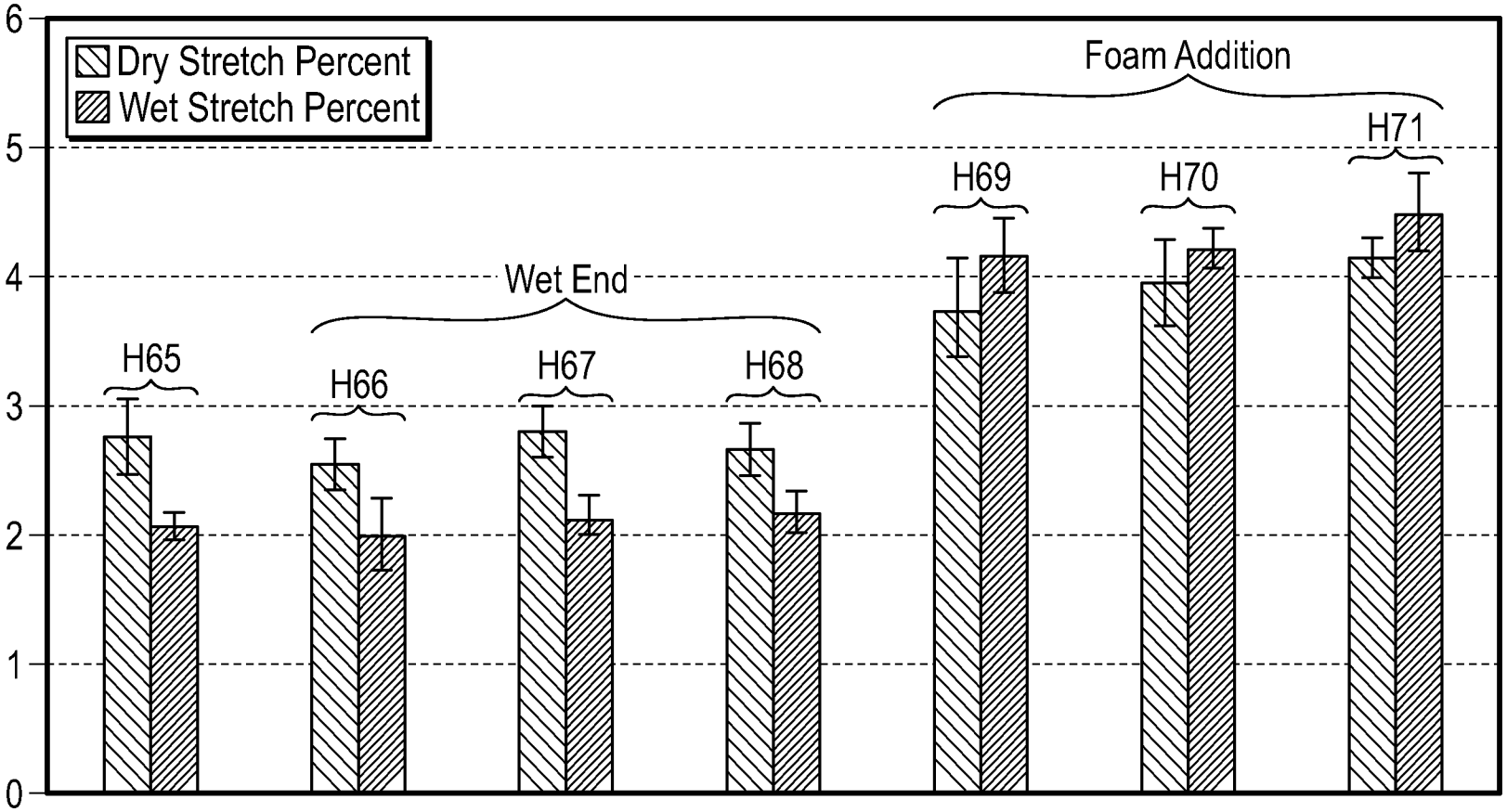
FIG. 10 shows a graph of dry and wet stretch results on virgin linerboard samples.

Handsheets were prepared using the same techniques as outlined above for Example 2A. Foams were prepared in accordance with the foam formation described in Example 2A. The dry and wet (rewetted) stretch of each of the samples were then tested. The results are shown in FIG. 10. The handsheets evaluated in FIG. 10 are described below in Table VIII.

TABLE VIII

| Handsheets | Foaming Agent Utilized | Charge of Foaming Agent | Amount of Synthetic Strength Additive I |
|---|---|---|---|
| Handsheet 65 (Comparative) | — | — | — |
| Handsheet 66 (Comparative) | — | — | 1 lb/ton (Wet-end addition) |
| Handsheet 67 (Comparative) | — | — | 2 lbs/ton (Wet-end addition) |
| Handsheet 68 (Comparative) | — | — | 4 lbs/ton (Wet-end addition) |
| Handsheet 69 (Exemplary) | Exemplary Foaming Agent III | Non-ionic | 1 wt. % |
| Handsheet 70 (Exemplary) | Exemplary Foaming Agent III | Non-ionic | 2 wt. % |
| Handsheet 71 (Exemplary) | Exemplary Foaming Agent III | Non-ionic | 5 wt. % |

Exemplary Foaming Agent III includes a polyvinyl alcohol which is non-ionic and commercially available from Solenis LLC of Wilmington, Del., under the trade name DeTac™ and from Sekisui Specialty Chemicals of Dallas, Tex., under the trade name Selvol™ 540.

Synthetic Strength Additive I includes a graft copolymer of a vinyl monomer and functionalized vinyl amine which is cationic and commercially available from Solenis LLC of Wilmington, Del., under the trade name Hercobond™ 7700.

As can be seen in FIG. 10, the wet-end addition of Hercobond™ 7700 decreased the dry and wet (rewetted) stretch of the samples with respect to the control. Again, without being bound by theory, it is possible that the addition of Hercobond™ 7700 was ineffective at improving stretch of the prepared samples due to interference from contaminants remaining in the pulp furnish from the pulping process.

As can also be seen in FIG. 10, the foam-assisted application of Hercobond™ 7700 had a clear beneficial effect on both dry and wet (rewetted) stretch. In particular, it was observed that with the application of Hercobond™ 7700 using the Selvol™ 540 foaming agent, the dry and wet stretch of the samples increased as compared to the control and as compared to wet-end addition of Hercobond™ 7700.

It is also shown in FIG. 10 that the foam assisted application of Hercobond™ 7700 shows a so-called "dosage response" in dry and wet (rewetted) stretch, i.e., that an increase in the concentration of Hercobond™ 7700 added to the sample resulted in a corresponding increase in both the dry and wet (rewetted) stretch of the samples. No such dosage response was observed in the results of the wet-end addition of Hercobond™ 7700.

Example 2C

Figure 11:
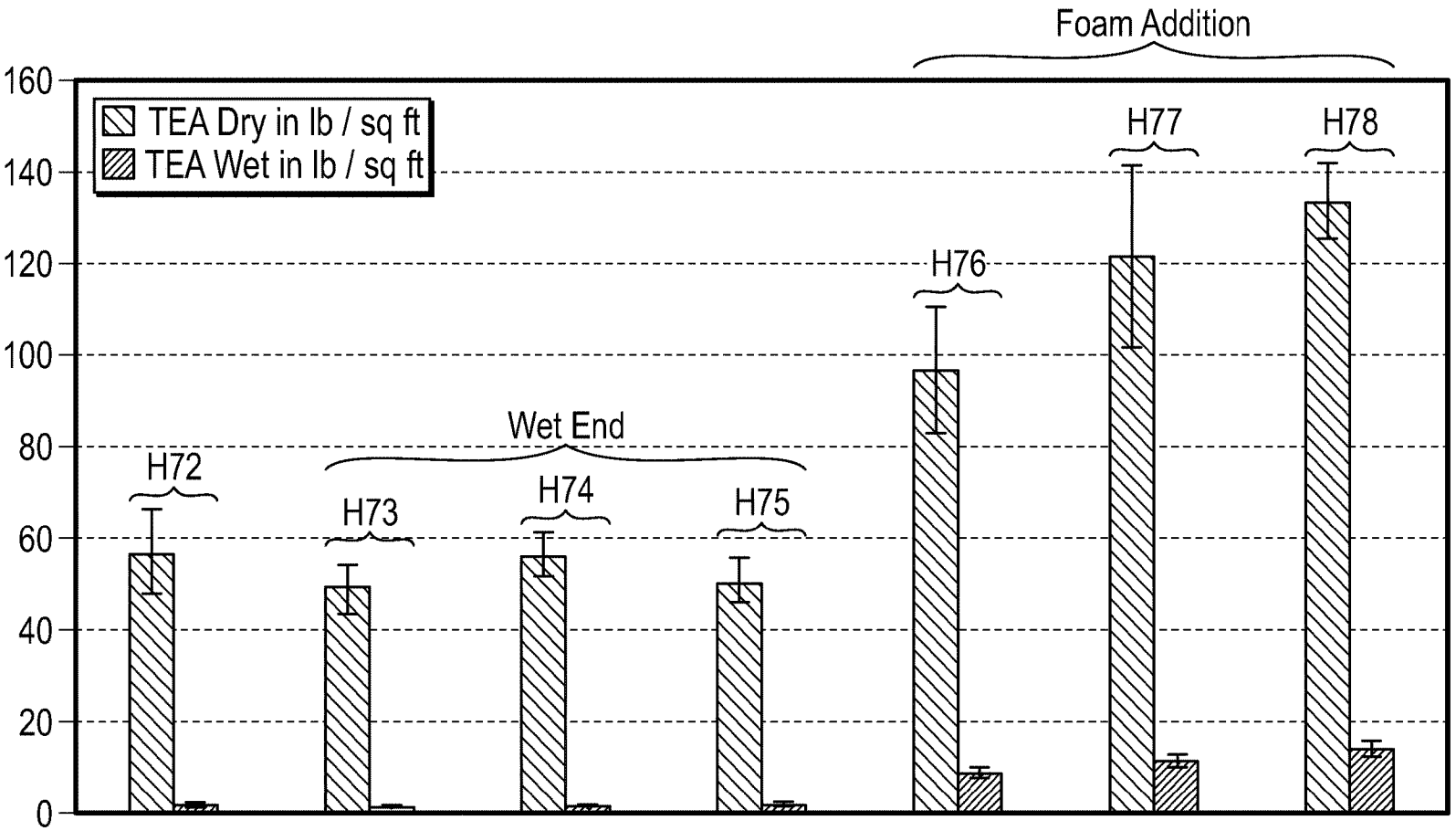
FIG. 11 shows a graph of dry and wet tensile energy absorption results on virgin linerboard samples.

Handsheets were prepared using the same techniques as outlined above for Example 2A. Foams were prepared in accordance with the foam formation described in Example 2A. The dry and wet tensile energy absorption (TEA) of each of the samples was then tested. The results are shown in FIG. 11. The handsheets evaluated in FIG. 11 are described below in Table IX.

TABLE IX

| Handsheets | Foaming Agent Utilized | Charge of Foaming Agent | Amount of Synthetic Strength Additive I |
|---|---|---|---|
| Handsheet 72 (Comparative) | — | — | — |
| Handsheet 73 (Comparative) | — | — | 1 lb/ton (Wet-end addition) |
| Handsheet 74 (Comparative) | — | — | 2 lbs/ton (Wet-end addition) |
| Handsheet 75 (Comparative) | — | — | 4 lbs/ton (Wet-end addition) |
| Handsheet 76 (Exemplary) | Exemplary Foaming Agent III | Non-ionic | 1 wt. % |
| Handsheet 77 (Exemplary) | Exemplary Foaming Agent III | Non-ionic | 2 wt. % |
| Handsheet 78 (Exemplary) | Exemplary Foaming Agent III | Non-ionic | 5 wt. % |

Exemplary Foaming Agent III includes a polyvinyl alcohol which is non-ionic and commercially available from Solenis LLC of Wilmington, Del., under the trade name DeTac™ and from Sekisui Specialty Chemicals of Dallas, Tex., under the trade name Selvol™ 540.

Synthetic Strength Additive I includes a graft copolymer of a vinyl monomer and functionalized vinyl amine which is cationic and commercially available from Solenis LLC of Wilmington, Del., under the trade name Hercobond™ 7700.

As can be seen in FIG. 11, the wet-end addition of Hercobond™ 7700 decreased the dry and wet (rewetted) TEA of the samples with respect to the control. Again, without being bound by theory, it is possible that the addition of Hercobond™ 7700 was ineffective at improving TEA of the prepared samples due to interference from substances remaining in the pulp furnish from the pulping process.

As can also be seen in FIG. 11, the foam-assisted application of Hercobond™ 7700 had a clear beneficial effect on both dry and wet (rewetted) TEA. In particular, it was observed that with the application of Hercobond™ 7700 with the Selvol™ 540 foaming agent, the dry and wet (rewetted) TEA of the samples increased as compared to the control and as compared to wet-end addition of Hercobond™ 7700.

It is also shown in FIG. 11 that the foam assisted application of Hercobond™ 7700 shows a so-called "dosage response" in dry and wet (rewetted) TEA, i.e., that an increase in the concentration of Hercobond™ 7700 added to the sample resulted in a corresponding increase in both the dry and wet (rewetted) TEA of the samples. No such dosage response was observed with the results of the wet-end addition of Hercobond™ 7700.

Example 2D

Figure 12:
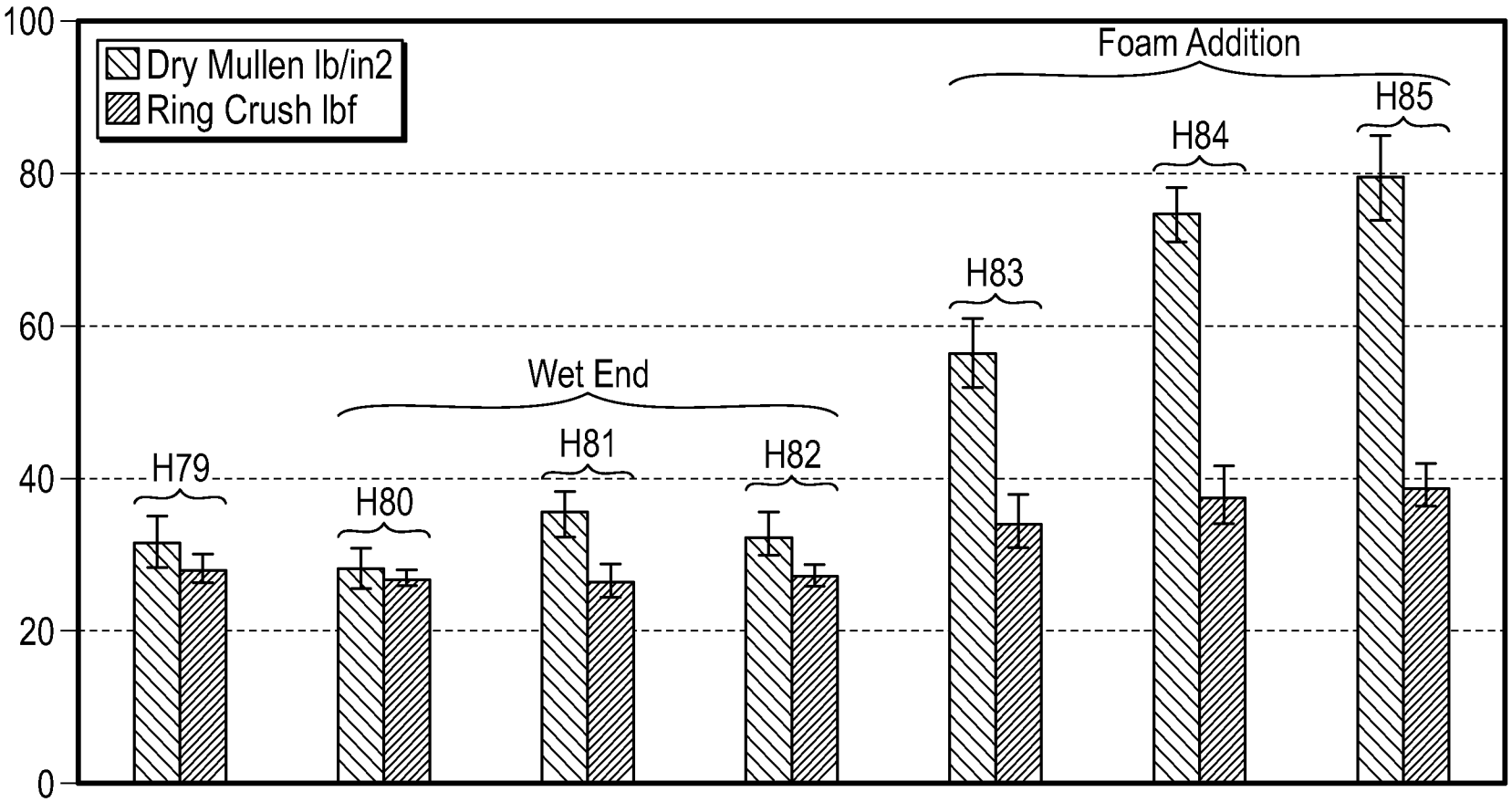
FIG. 12 shows a graph of dry Mullen and ring crush results on virgin linerboard samples.

Handsheets were prepared using the same techniques as outlined above for Example 2A. Foams were prepared in accordance with the foam formation described in Example 2A. The dry bursting strength and ring crush strength of each of the samples was then tested. The results are shown in FIG. 12. The handsheets evaluated in FIG. 12 are described below in Table X.

TABLE X

| Handsheets | Foaming Agent Utilized | Charge of Foaming Agent | Amount of Synthetic Strength Additive I |
|---|---|---|---|
| Handsheet 79 (Comparative) | — | — | — |
| Handsheet 80 (Comparative) | — | — | 1 lb/ton (Wet-end addition) |
| Handsheet 81 (Comparative) | — | — | 2 lbs/ton (Wet-end addition) |
| Handsheet 82 (Comparative) | — | — | 4 lbs/ton (Wet-end addition) |
| Handsheet 83 (Exemplary) | Exemplary Foaming Agent III | Non-ionic | 1 wt. % |
| Handsheet 84 (Exemplary) | Exemplary Foaming Agent III | Non-ionic | 2 wt. % |
| Handsheet 85 (Exemplary) | Exemplary Foaming Agent III | Non-ionic | 5 wt. % |

Exemplary Foaming Agent III includes a polyvinyl alcohol which is non-ionic and commercially available from Solenis LLC of Wilmington, Del., under the trade name DeTac™ and from Sekisui Specialty Chemicals of Dallas, Tex., under the trade name Selvol™ 540.

Synthetic Strength Additive I includes a graft copolymer of a vinyl monomer and functionalized vinyl amine which is cationic and commercially available from Solenis LLC of Wilmington, Del., under the trade name Hercobond™ 7700.

As can be seen in FIG. 12, the wet-end addition of the synthetic cationic strength additive decreased the ring crush strength of each of the samples, and either decreased or only marginally improved the bursting strength with respect to the control. Again, without being bound by theory, it is possible that the addition of the synthetic cationic strength additive was ineffective at improving the ring crush strength and had only a minimal effect on the bursting strength of the prepared samples due to interference from substances remaining in the pulp furnish from the pulping process.

As can also be seen in FIG. 12, the foam-assisted application of Hercobond™ 7700 had a clear beneficial effect on both bursting strength and ring crush strength. In particular, it was observed that with the application of Hercobond™ 7700 with the Selvol™ 540 foaming agent, the bursting strength and ring crush strength of the samples increased as compared to the control and as compared to wet-end addition of Hercobond™ 7700.

It is also shown in FIG. 12 that the foam assisted application of Hercobond™ 7700 shows a so-called "dosage response" in both bursting strength and ring crush strength, i.e., that an increase in the concentration of Hercobond™ 7700 added to the sample resulted in a corresponding increase in both the bursting strength and ring crush strength of the samples. No such dosage response was observed with the wet-end addition of Hercobond™ 7700.

Example 2E

Figure 13:
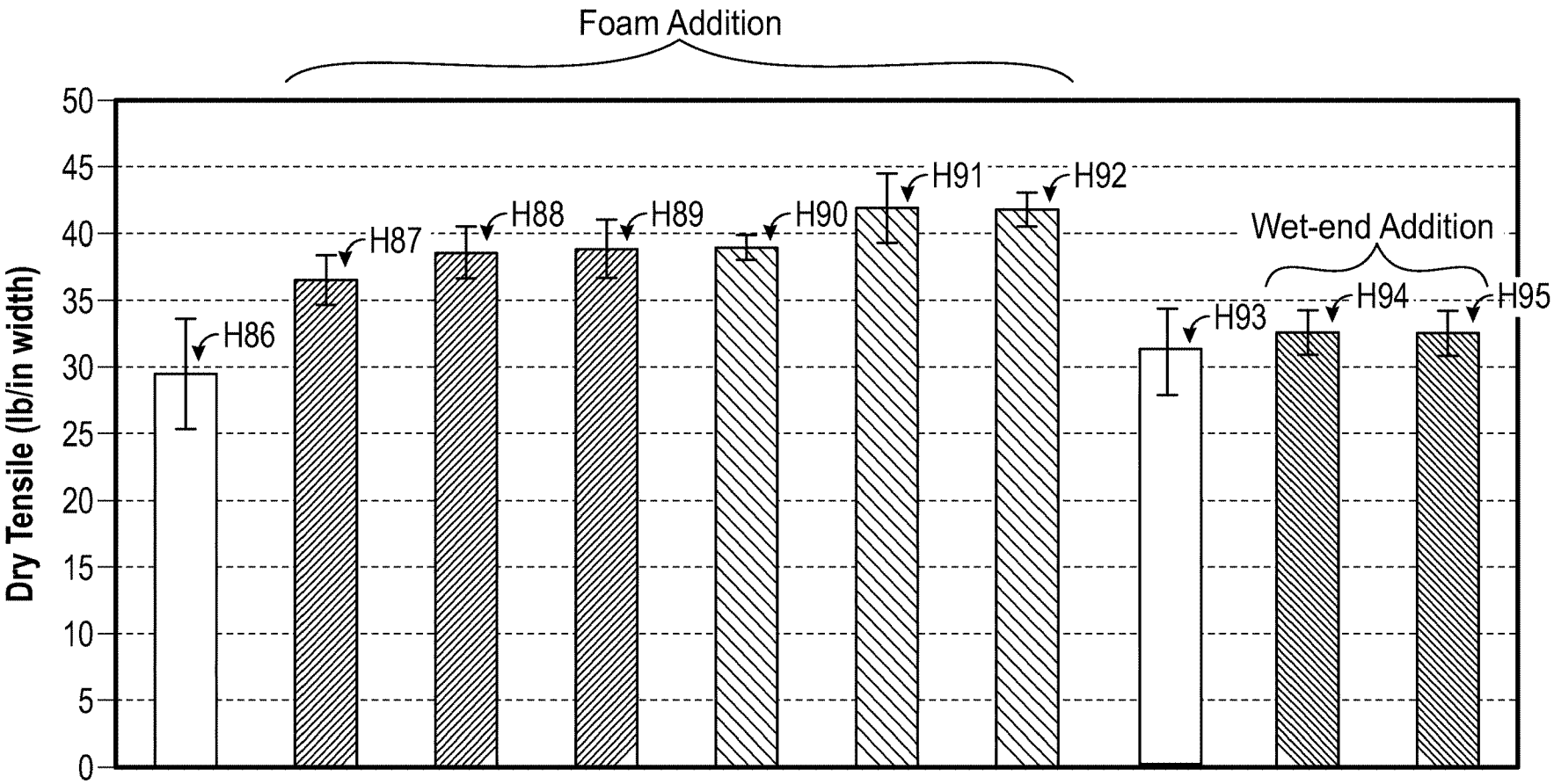
FIG. 13 shows a graph of dry tensile strength results on virgin linerboard.

Handsheets of about 150 gsm were produced using never-dried unbleached virgin kraft slush pulp. The methods of preparation of the handsheets were the same as with Example 2A. Foams were prepared using 1%-5% solutions of a polyvinyl amine-containing synthetic cationic dry strength additive (commercially available as Hercobond™ 7700). The foams were pre-formed in the presence of either an amphoteric dimethylamine oxide-based surfactant (Macat® AO-12) or polyvinyl alcohol, (Selvol™ 540) prior to application onto a wet formed web. The dry tensile strength of each one of the samples were tested, together with a foam control sample, a wet-end control sample (each control with no treatment), and samples that were prepared with the wet-end addition of 1 lb/ton Hercobond™ 7700 and 2 lbs/ton Hercobond™ 7700. The results of the dry tensile strength testing are shown in FIG. 13. The handsheets evaluated in FIG. 13 are described below in Table XI.

TABLE XI

| Handsheets | Foaming Agent Utilized | Charge of Foaming Agent | Amount of Synthetic Strength Additive I |
|---|---|---|---|
| Handsheet 86 (Comparative) | Exemplary Foaming Agent I | Amphoteric | — |
| Handsheet 87 (Exemplary) | Exemplary Foaming Agent I | Amphoteric | 1 wt. % |
| Handsheet 88 (Exemplary) | Exemplary Foaming Agent I | Amphoteric | 2 wt. % |
| Handsheet 89 (Exemplary) | Exemplary Foaming Agent I | Amphoteric | 5 wt. % |
| Handsheet 90 (Exemplary) | Exemplary Foaming Agent III | Non-ionic | 1 wt. % |
| Handsheet 91 (Exemplary) | Exemplary Foaming Agent III | Non-ionic | 2 wt. % |
| Handsheet 92 (Exemplary) | Exemplary Foaming Agent III | Non-ionic | 5 wt. % |
| Handsheet 93 (Comparative) | — | — | — |
| Handsheet 94 (Comparative) | — | — | 1 lb/ton (Wet-end addition) |
| Handsheet 95 (Comparative) | — | — | 2 lbs/ton (Wet-end addition) |

Exemplary Foaming Agent I includes an amine oxide which is amphoteric and commercially available from Pilot Chemical under the trade name Macat® AO-12.

Exemplary Foaming Agent III includes a polyvinyl alcohol which is non-ionic and commercially available from Solenis LLC of Wilmington, Del., under the trade name DeTac™ and from Sekisui Specialty Chemicals of Dallas, Tex., under the trade name Selvol™ 540.

Synthetic Strength Additive I includes a graft copolymer of a vinyl monomer and functionalized vinyl amine which is cationic and commercially available from Solenis LLC of Wilmington, Del., under the trade name Hercobond™ 7700.

As shown in FIG. 13, the wet end addition of Hercobond™ 7700 at 1-2 lbs/ton shows only a minor improvement in dry tensile strength as compared to the wet-end control sample. The foam assisted addition of Hercobond™ 7700 demonstrated up to a 30% improvement in the presence of the amphoteric foaming agent Macat® AO-12. In the presence of the polyvinyl alcohol foaming agent Selvol™ 540, an improvement of dry tensile strength of up to 40% was observed. Polyvinyl alcohol is known as a dry strength additive alone. The use of a polyvinyl alcohol-based foaming agent resulted in a synergistic effect with dry strength additives, in terms of the improvement to the dry tensile strength of the samples.

Example 2F

Figure 14:
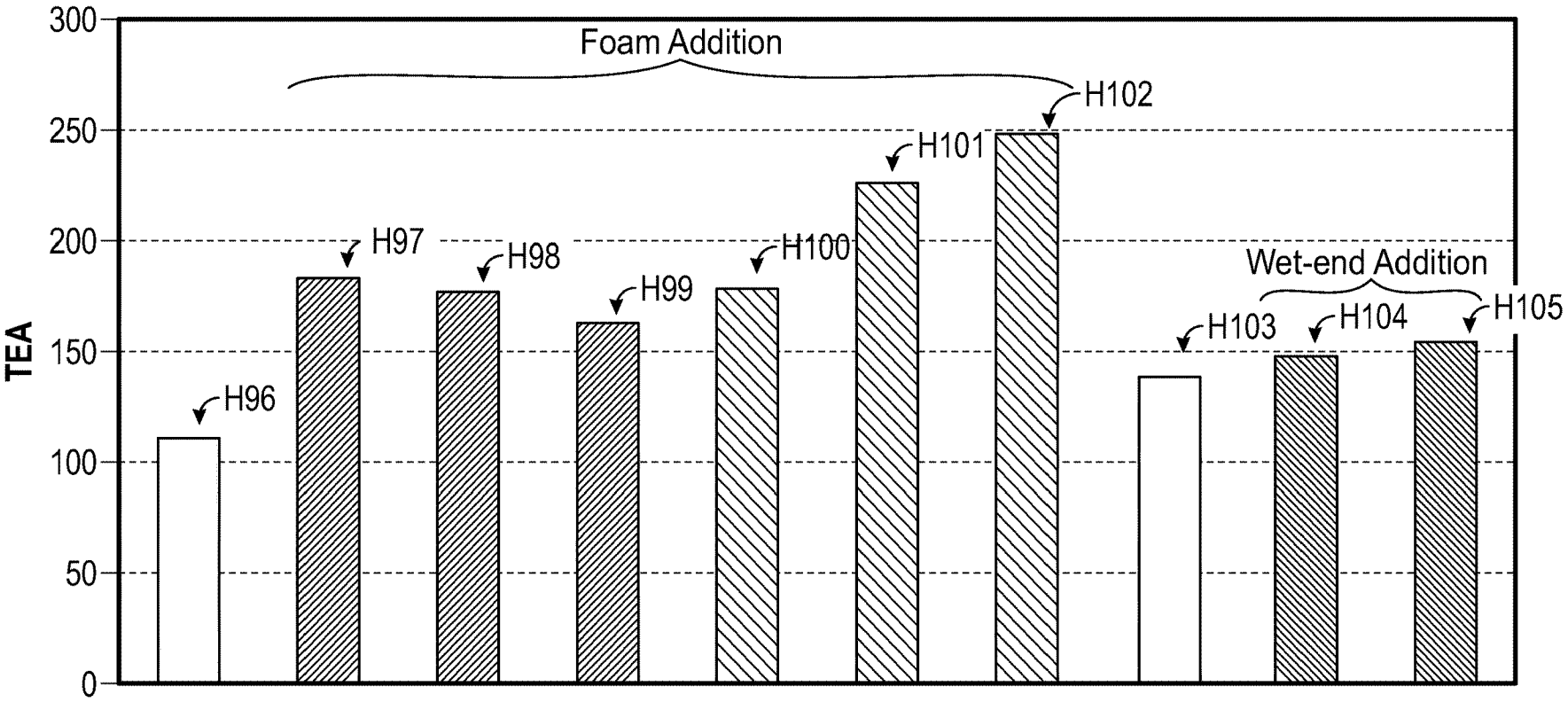
FIG. 14 shows a graph of dry tensile energy absorption results on virgin linerboard samples.

Handsheets were prepared using the same techniques as outlined above for Example 2E. Foams were prepared in accordance with the foam formation described in Example 2A. The tensile energy absorption (TEA) of each of the samples was then tested. The results are shown in FIG. 14. The handsheets evaluated in FIG. 14 are described below in Table XII.

TABLE XII

| Handsheets | Foaming Agent Utilized | Charge of Foaming Agent | Amount of Synthetic Strength Additive I |
|---|---|---|---|
| Handsheet 96 (Comparative) | Exemplary Foaming Agent I | Amphoteric | — |
| Handsheet 97 (Exemplary) | Exemplary Foaming Agent I | Amphoteric | 1 wt. % |
| Handsheet 98 (Exemplary) | Exemplary Foaming Agent I | Amphoteric | 2 wt. % |
| Handsheet 99 (Exemplary) | Exemplary Foaming Agent I | Amphoteric | 5 wt. % |
| Handsheet 100 (Exemplary) | Exemplary Foaming Agent III | Non-ionic | 1 wt. % |
| Handsheet 101 (Exemplary) | Exemplary Foaming Agent III | Non-ionic | 2 wt. % |
| Handsheet 102 (Exemplary) | Exemplary Foaming Agent III | Non-ionic | 5 wt. % |
| Handsheet 103 (Comparative) | — | — | — |
| Handsheet 104 (Comparative) | — | — | 1 lb/ton (Wet-end addition) |
| Handsheet 105 (Comparative) | — | — | 2 lbs/ton (Wet-end addition) |

Exemplary Foaming Agent I includes an amine oxide which is amphoteric and commercially available from Pilot Chemical under the trade name Macat® AO-12.

Exemplary Foaming Agent III includes a polyvinyl alcohol which is non-ionic and commercially available from Solenis LLC of Wilmington, Del., under the trade name DeTac™ and from Sekisui Specialty Chemicals of Dallas, Tex., under the trade name Selvol™ 540.

Synthetic Strength Additive I includes a graft copolymer of a vinyl monomer and functionalized vinyl amine which is cationic and commercially available from Solenis LLC of Wilmington, Del., under the trade name Hercobond™ 7700.

As can be seen in FIG. 14, the wet-end addition of Hercobond™ 7700 resulted in a small improvement in TEA over the untreated wet-end control. The foam assisted addition of dry strength additives provided a significant improvement in TEA as compared to the untreated foam control sample. As can be seen in FIG. 14, the foam addition provided up to a 65% improvement in TEA through the use of the amphoteric-based foaming agent Macat® AO-12, and up to 120% improvement in TEA through the use of the polyvinyl alcohol-based foaming agent Selvol™ 540.

Example 2G

Figure 15:
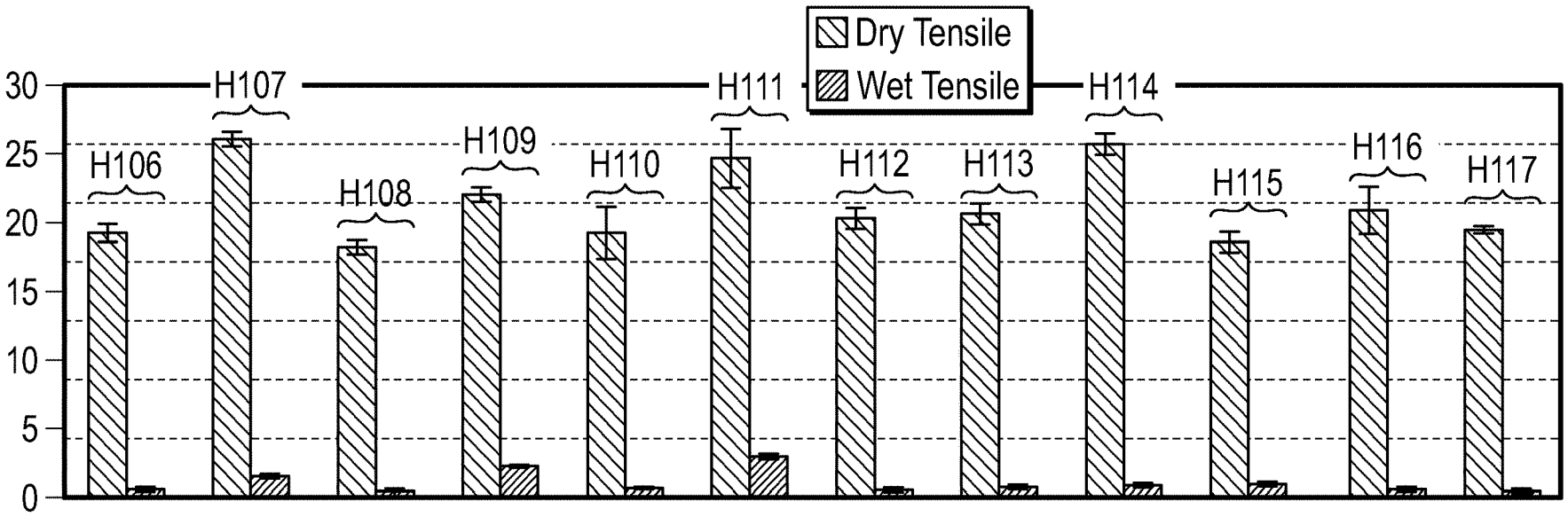
FIG. 15 shows a graph of dry and wet tensile strength results on virgin linerboard samples.

Handsheets of about 100 gsm were produced using the same equipment and procedures used in Example 2A, using 750 CSF never dried unbleached virgin kraft slush pulp. Foams designed to apply approximately equivalent amounts of certain dry strength additives as of wet end dosage were applied onto the wet formed sheets. Foams were prepared in accordance with the foam formation described in Example 2A. In order to determine the strength improvements of different types of strength additives, different dry strength additives were incorporated into the foam. The strength additives used were Hercobond™ 7700, Hercobond™ 6950 and Hercobond™ 6350, all of which contain primary amine functional units in the form of polyvinylamine polymer units. Further strength additives used were Hercobond™ 1630 and Hercobond™ 1307, which do not contain polyvinylamine polymer units. The foaming agent used was an alkyl polyglucoside, (Dow™ BG-10). The dry and wet (rewetted) tensile strength of each of the samples was then tested. The results of the tensile testing are shown in FIG. 15. The handsheets evaluated in FIG. 15 are described below in Table XIII.

TABLE XIII

| Handsheets | Foaming Agent Utilized | Synthetic Strength Additive | Amount of Synthetic Strength Additive |
|---|---|---|---|
| Handsheet 106 (Comparative) | — | — | — |
| Handsheet 107 (Exemplary) | Exemplary Foaming Agent II | Synthetic Strength Additive I | 1 wt. % |
| Handsheet 108 (Comparative) | — | Synthetic Strength Additive I | 4 lbs/ton (Wet-end addition) |
| Handsheet 109 (Exemplary) | Exemplary Foaming Agent II | Synthetic Strength Additive II | 0.5 wt. % |
| Handsheet 110 (Comparative) | — | Synthetic Strength Additive II | 2 lbs/ton (Wet-end addition) |
| Handsheet 111 (Exemplary) | Exemplary Foaming Agent II | Synthetic Strength Additive III | 0.72 wt. % |
| Handsheet 112 (Comparative) | — | Synthetic Strength Additive III | 2 lbs/ton (Wet-end addition) |
| Handsheet 113 (Exemplary) | Exemplary Foaming Agent II | Synthetic Strength Additive IV | 2.44 wt. % |
| Handsheet 114 (Comparative) | — | Synthetic Strength Additive IV | 8 lbs/ton (Wet-end addition) |
| Handsheet 115 (Exemplary) | Exemplary Foaming Agent II | Synthetic Strength Additive V | 1 wt. % |
| Handsheet 116 (Comparative) | — | Synthetic Strength Additive V | 2 lbs/ton (Wet-end addition) |
| Handsheet 117 (Comparative) | — | — | — |

Exemplary Foaming Agent II includes an alkyl polyglucoside which is non-ionic and commercially available from Dow Chemical under the trade name Triton™ BG-10.

Synthetic Strength Additive I includes a graft copolymer of a vinyl monomer and functionalized vinyl amine which is cationic and commercially available from Solenis LLC of Wilmington, Del., under the trade name Hercobond™ 7700.

Synthetic Strength Additive II includes a vinylamine containing polymers and copolymers which is cationic and commercially available from Solenis LLC of Wilmington, Del., under the trade name Hercobond™ 6950.

Synthetic Strength Additive III includes a vinylamine containing polymers and copolymers which is cationic and commercially available from Solenis LLC of Wilmington, Del., under the trade name Hercobond™ 6350.

Synthetic Strength Additive IV includes a dimethylaminoethylmethacrylate which is amphoteric and commercially available from Solenis LLC of Wilmington, Del., under the trade name Hercobond™ 1630.

Synthetic Strength Additive V includes a glyoxylated acrylamide-diallyldimethylammonium chloride copolymers which is cationic and commercially available from Solenis LLC of Wilmington, Del., under the trade name Hercobond™ 1307.

As can be seen in FIG. 15, the samples prepared with synthetic cationic strength additives that contain primary amine functional units showed better tensile strength performance than the samples prepared with strength additives that did not contain primary amine functional units. Furthermore, the handsheets made from foam assisted application of strength additives that contain primary amine functional units showed better tensile strength performance than the handsheets prepared using the equivalent amount of strength additive with wet-end addition.

Example 2H

Figure 16:
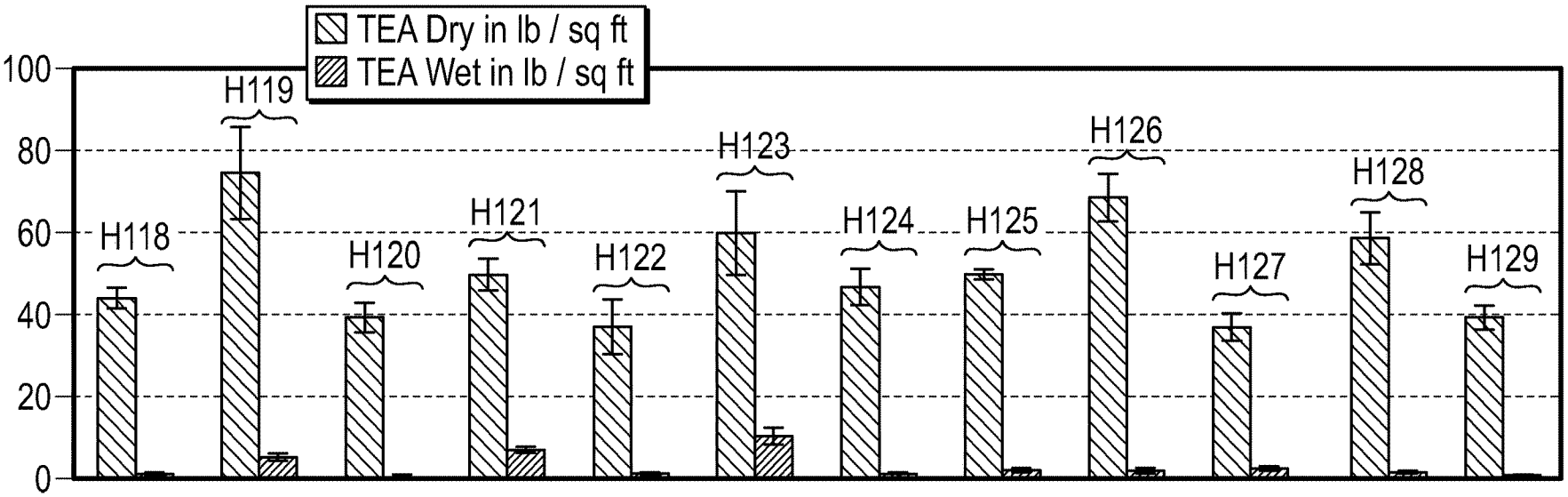
FIG. 16 shows a graph of dry and wet tensile energy absorption results on virgin linerboard samples.

Handsheets were prepared using the same methods as for Example 2G. Foams were prepared in accordance with the foam formation described in Example 2A. The tensile energy absorption (TEA) of each sample was then tested. The results of the tensile energy absorption are shown in FIG. 16. The handsheets evaluated in FIG. 16 are described below in Table XIV.

TABLE XIV

| Handsheets | Foaming Agent Utilized | Synthetic Strength Additive | Amount of Synthetic Strength Additive |
|---|---|---|---|
| Handsheet 118 (Comparative) | — | — | — |
| Handsheet 119 (Exemplary) | Exemplary Foaming Agent II | Synthetic Strength Additive I | 1 wt. % |
| Handsheet 120 (Comparative) | — | Synthetic Strength Additive I | 4 lbs/ton (Wet-end addition) |
| Handsheet 121 (Exemplary) | Exemplary Foaming Agent II | Synthetic Strength Additive II | 0.5 wt. % |
| Handsheet 122 (Comparative) | — | Synthetic Strength Additive II | 2 lbs/ton (Wet-end addition) |
| Handsheet 123 (Exemplary) | Exemplary Foaming Agent II | Synthetic Strength Additive III | 0.72 wt. % |
| Handsheet 124 (Comparative) | — | Synthetic Strength Additive III | 2 lbs/ton (Wet-end addition) |
| Handsheet 125 (Exemplary) | Exemplary Foaming Agent II | Synthetic Strength Additive IV | 2.44 wt. % |
| Handsheet 126 (Comparative) | — | Synthetic Strength Additive IV | 8 lbs/ton (Wet-end addition) |
| Handsheet 127 (Exemplary) | Exemplary Foaming Agent II | Synthetic Strength Additive V | 1 wt. % |
| Handsheet 128 (Comparative) | — | Synthetic Strength Additive V | 2 lbs/ton (Wet-end addition) |
| Handsheet 129 (Comparative) | — | — | — |

Exemplary Foaming Agent II includes an alkyl polyglucoside which is non-ionic and commercially available from Dow Chemical under the trade name Triton™ BG-10.

Synthetic Strength Additive I includes a graft copolymer of a vinyl monomer and functionalized vinyl amine which is cationic and commercially available from Solenis LLC of Wilmington, Del., under the trade name Hercobond™ 7700.

Synthetic Strength Additive II includes a vinylamine containing polymers and copolymers which is cationic and commercially available from Solenis LLC of Wilmington, Del., under the trade name Hercobond™ 6950.

Synthetic Strength Additive III includes a vinylamine containing polymers and copolymers which is cationic and commercially available from Solenis LLC of Wilmington, Del., under the trade name Hercobond™ 6350.

Synthetic Strength Additive IV includes a dimethylaminoethylmethacrylate which is amphoteric and commercially available from Solenis LLC of Wilmington, Del., under the trade name Hercobond™ 1630.

Synthetic Strength Additive V includes a glyoxylated acrylamide-diallyldimethylammonium chloride copolymers which is cationic and commercially available from Solenis LLC of Wilmington, Del., under the trade name Hercobond™ 1307.

As can be seen in FIG. 16, the samples prepared using strength additives that contain primary amine functional units showed better TEA performance than the samples prepared with strength additives that did not contain primary amine functional units. Furthermore, the handsheet samples made from the foam assisted application of strength additives that contain primary amine functional units showed better TEA performance than the handsheet samples prepared via wet-end addition of the equivalent amount of the same strength additive.

Example 3A

Handsheets of about 100 gsm were produced using 370 Canadian standard freeness (CSF) recycled linerboard pulp. Foams without any strength additives were formed in the presence of various foaming agents (including anionic, zwitterionic, and nonionic types). These foams were applied onto the wet formed sheets.

The foaming agents used in Example 3A include SDS from Sigma Aldrich, Crodateric™ CAS 50, Crodateric™ CAB 30, and Multitrope™ 1620 from Croda Inc., Macat® AO-12 from Pilot Chemical Co., Glucopon® 425N from BASF Corp., Triton™ BG-10 and Triton™ CG-110 from Dow Chemical Co. The concentration of each foaming agent was adjusted so that each foam contained around 70% air content.

The wet formed sheets were produced using the Noble and Wood handsheet equipment. The formed wet sheets were transferred to a foam application device that allowed for the application of a vacuum after foam addition. Foam was then applied using a draw down device. The amount of applied foam was carefully controlled. The amount of applied foam could be estimated by the height of foam applied to the sheet and was subsequently confirmed by calibration experiments monitoring the nitrogen content of known amounts of applied strength additives.

Figure 17:
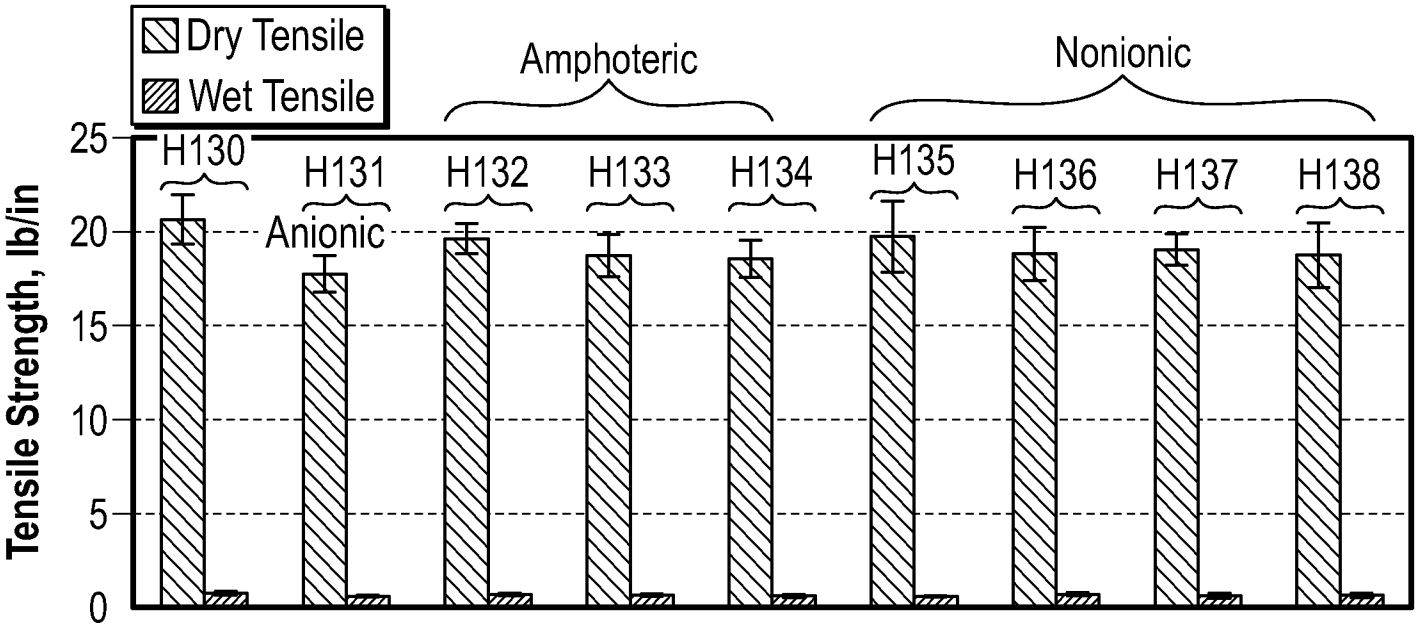
FIG. 17 shows a graph of dry and wet tensile strength results for different foaming agents on recycled linerboard samples.

The tensile strength of each sample sheet was tested for each condition against a control (without any foam or chemical additives). The results of the tensile testing are shown in FIG. 17. The handsheets evaluated in FIG. 17 are described below in Table XV.

TABLE XV

| Handsheets | Foaming Agent Utilized | Charge of Foaming Agent | Amount of Synthetic Strength Additive I |
|---|---|---|---|
| Handsheet 130 (Comparative) | — | — | — |
| Handsheet 131 (Comparative) | Comparative Foaming Agent I | Anionic | — |
| Handsheet 132 (Exemplary) | Exemplary Foaming Agent V | Amphoteric | — |
| Handsheet 133 (Exemplary) | Exemplary Foaming Agent XIV | Amphoteric | — |
| Handsheet 134 (Exemplary) | Exemplary Foaming Agent I | Amphoteric | — |
| Handsheet 135 (Exemplary) | Exemplary Foaming Agent II | Non-ionic | — |
| Handsheet 136 (Exemplary) | Exemplary Foaming Agent IV | Non-ionic | — |
| Handsheet 137 (Exemplary) | Exemplary Foaming Agent XV | Non-ionic | — |
| Handsheet 138 (Exemplary) | Exemplary Foaming Agent VI | Non-ionic | — |

Exemplary Foaming Agent I includes an amine oxide which is amphoteric and commercially available from Pilot Chemical under the trade name Macat® AO-12.

Exemplary Foaming Agent II includes an alkyl polyglucoside which is non-ionic and commercially available from Dow Chemical under the trade name Triton™ BG-10.

Exemplary Foaming Agent IV includes an alkyl polyglucoside which is non-ionic and commercially available from BASF under the trade name Glucopon® 425N.

Exemplary Foaming Agent V includes a cocamidopropyl hydroxysultaine which is zwitterionic and commercially available from Croda under the trade name Crodateric™ CAS 50.

Exemplary Foaming Agent VI includes a polysaccharide which is non-ionic and commercially available from Croda under the trade name Multitrope™ 1620.

Exemplary Foaming Agent XIV includes a cocamidopropyl betaine which is amphoteric and commercially available from Croda under the trade name Crodateric™ CAB 30.

Exemplary Foaming Agent XV includes an alkyl polyglucoside which is non-ionic and commercially available from Dow Chemical under the trade name Triton™ CG-110.

Comparative Foaming Agent I includes sodium dodecyl sulfate which is anionic and commercially available from various sources.

Synthetic Strength Additive I includes a graft copolymer of a vinyl monomer and functionalized vinyl amine which is cationic and commercially available from Solenis LLC of Wilmington, Del., under the trade name Hercobond™ 7700.

As can be seen in FIG. 17, the different foaming agents (prepared without strength additives) have different impacts on the strength properties of the samples. SDS, an anionic surfactant, reduced dry tensile strength by around 15% as compared to the control. Among the zwitterionic surfactants, Crodateric™ CAS 50 from Croda Inc., a cocamidopropyl hydroxysultain based surfactant, has comparable dry tensile strength with the control. For the nonionic surfactants, Triton™ BG-10 from Dow Chemical Co., an alkyl polyglucoside based foaming agent, also produced a comparable dry tensile strength compared to the control. Other foaming agents produced slightly decreased dry strength as compared to the control. As can be seen in this figure, similar results were obtained with wet (rewetted) tensile testing of the samples.

Example 3B

Handsheets of about 100 gsm were produced using 370 CSF recycled linerboard pulp with no white water recycle. Foams were prepared using 1% by weight (as of product in the foaming solution) of Hercobond™ 7700, a synthetic cationic dry strength additive from Solenis LLC, using various different foaming agents, prior to applying the foams onto a wet formed sheet.

The foaming agents used in this example include Triton™ BG-10 and Triton™ X-100 from Dow Chemical Co., Glucopon® 425N from BASF Corp., Macat® AO-12 from Pilot Chemical Co., Mona™ AT-1200, NatSurf™ 265, Tween® 20, Tween® 80, Multitrope™ 1620, Crodateric™ CAS 50, Crodasinic™ LS30, Diversaclean™, and Forestall™ from Croda Inc. In the control sheet, no foaming agents or dry strength additive was added during sheet formation. Handsheets with Hercobond™ 7700 at 4 lbs/ton added via traditional wet end addition were also prepared to compare with foam addition samples. In a separate dosage calibration test, results suggest the foam addition from 1% of Hercobond™ 7700 (as product) foaming solution provides an equivalent dosage as the wet-end addition level of 4 lbs/ton of Hercobond™ 7700 (as product).

Figure 18:
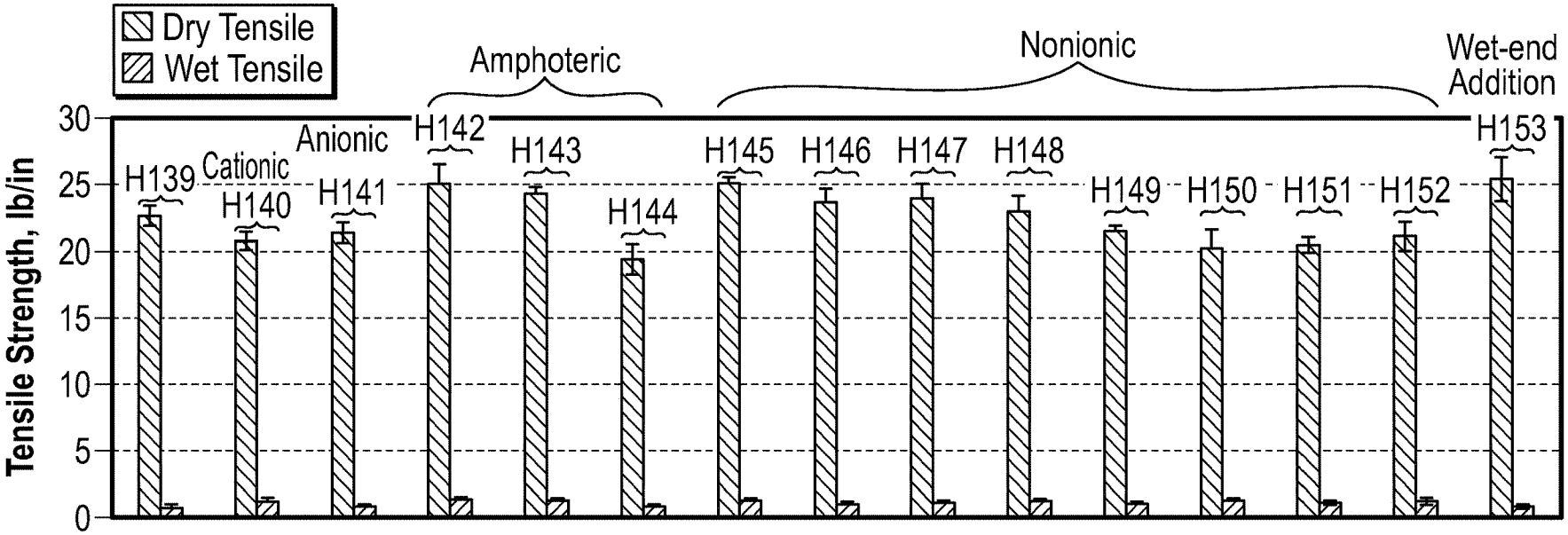
FIG. 18 shows another graph of dry and wet tensile strength results for different foaming agents on recycled linerboard samples.

The tensile strength of each of the samples was then tested. The results of the tensile testing are shown in FIG. 18. The handsheets evaluated in FIG. 18 are described below in Table XVI.

TABLE XVI

| Handsheets | FoCharge ofaming Agent Utilized | Foaming Agent | Amount of Synthetic Strength Additive I |
|---|---|---|---|
| Handsheet 139 (Comparative) | — | — | — |
| Handsheet 140 (Exemplary) | Exemplary Foaming Agent XIII | Cationic | 1 wt. % |
| Handsheet 141 (Comparative) | Comparative Foaming Agent II | Anionic | 1 wt. % |
| Handsheet 142 (Exemplary) | Exemplary Foaming Agent I | Amphoteric | 1 wt. % |
| Handsheet 143 (Exemplary) | Exemplary Foaming Agent V | Amphoteric | 1 wt. % |
| Handsheet 144 (Exemplary) | Exemplary Foaming Agent IX | Amphoteric | 1 wt. % |
| Handsheet 145 (Exemplary) | Exemplary Foaming Agent II | Non-ionic | 1 wt. % |
| Handsheet 146 (Exemplary) | Exemplary Foaming Agent IV | Non-ionic | 1 wt. % |
| Handsheet 147 (Exemplary) | Exemplary Foaming Agent VII | Non-ionic | 1 wt. % |
| Handsheet 148 (Exemplary) | Exemplary Foaming Agent VIII | Non-ionic | 1 wt. % |
| Handsheet 149 (Exemplary) | Exemplary Foaming Agent IX | Non-ionic | 1 wt. % |

Exemplary Foaming Agent I includes an amine oxide which is amphoteric and commercially available from Pilot Chemical under the trade name Macat® AO-12.

Exemplary Foaming Agent II includes an alkyl polyglucoside which is non-ionic and commercially available from Dow Chemical under the trade name Triton™ BG-10.

Exemplary Foaming Agent III includes a polyvinyl alcohol which is non-ionic and commercially available from Solenis LLC of Wilmington, Del., under the trade name DeTac™ and from Sekisui Specialty Chemicals of Dallas, Tex., under the trade name Selvol™ 540.

Exemplary Foaming Agent IV includes an alkyl polyglucoside which is non-ionic and commercially available from BASF under the trade name Glucopon® 425N.

Exemplary Foaming Agent V includes a cocamidopropyl hydroxysultaine which is zwitterionic and commercially available from Croda under the trade name Crodateric™ CAS 50.

Exemplary Foaming Agent VI includes a polysaccharide which is non-ionic and commercially available from Croda under the trade name Multitrope™ 1620.

Exemplary Foaming Agent VII includes an ethoxylated alcohol which is non-ionic and commercially available from Croda under the trade name NatSurf™ 265.

Exemplary Foaming Agent VIII includes a polyethylene glycol which is non-ionic and commercially available from Dow Chemical under the trade name Triton™ X-100.

Exemplary Foaming Agent IX includes a betaine which is zwitterionic and commercially available from Croda under the trade name Mona™ AT-1200.

Exemplary Foaming Agent X includes a hexitol ester which is non-ionic and commercially available from Croda under the trade name Tween® 80.

Exemplary Foaming Agent XI includes a hexitol ester which is non-ionic and commercially available from Croda under the trade name Tween® 20.

Exemplary Foaming Agent XII includes a mixture of an alkyl polyglucoside and an alkoxylated alcohol which are non-ionic and commercially available from Croda under the trade name Diversaclean™.

Exemplary Foaming Agent XIII includes an alkyl quaternary ammonium which is cationic and commercially available from Croda under the trade name Forestall™.

Comparative Foaming Agent II includes a lauroyl sarcosinate which is anionic and commercially available from Croda under the trade name Crodasinic™ LS30.

Synthetic Strength Additive I includes a graft copolymer of a vinyl monomer and functionalized vinyl amine which is cationic and commercially available from Solenis LLC of Wilmington, Del., under the trade name Hercobond™ 7700.

The choice of foaming agent used in combination with the Hercobond™ 7700 has a large effect on both the dry and wet (rewetted) tensile strength of the handsheet. All of the foams applied to the handsheets with the various different foaming agents contained the same amount of dry strength additive. Some foaming agents, such as Mona™ AT-1200, used in combination with the dry strength additive reduced the tensile strength of the handsheet sample to below that of the control sheet. Some foaming agents (e.g. Triton™ BG-10, Macat® AO-12), when used in combination with the dry strength additive, improved the dry tensile strength to a level equal to that of the wet end addition. The results show most of the foaming agents (Forestall™, Macat® AO-12, Crodateric™ CAS 50, Triton™ BG-10, Glucopon® 425N, Multitrope™ 1620, NatSurf™ 265, Triton™ X-100, Tween® 20, Tween® 80, and Diversaclean™), when used in combination with dry strength additives, provide higher wet (rewetted) tensile strength as compared to those made with wet end addition.

Example 3C

Figure 19:
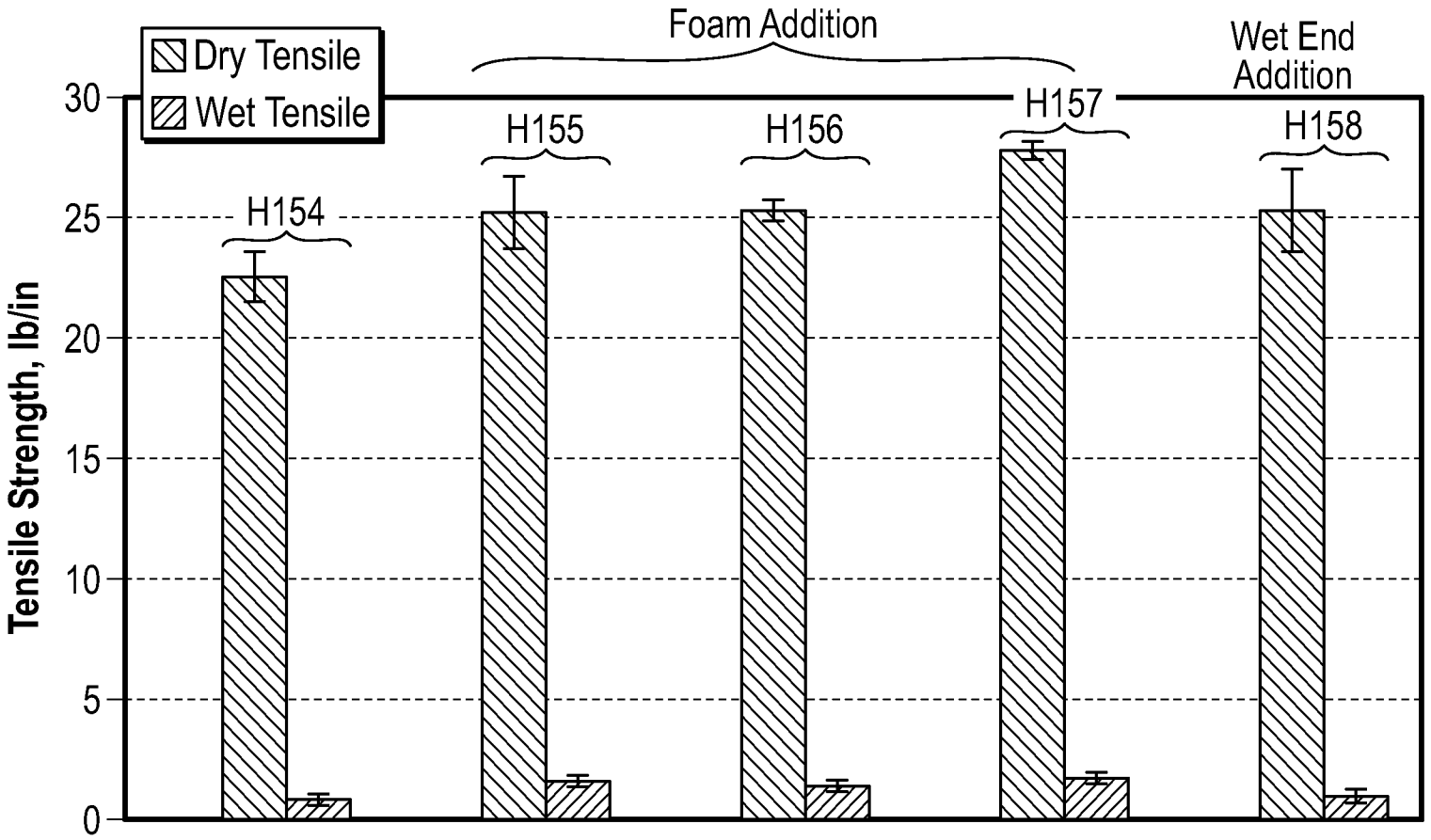
FIG. 19 shows another graph of dry and wet tensile strength results for different foaming agents on recycled linerboard samples.

Handsheets of about 100 gsm were produced using the same equipment and procedures described above in Example 3A, using 370 CSF recycled linerboard pulp. Foam assisted application of the synthetic cationic strength additive Hercobond™ 7700 from Solenis LLC was performed on some of the sample handsheets. The foaming agent used was Selvol™ 540 from Sekisui Chemical Co., a polyvinyl alcohol-based foaming agent. Selvol™ 540 has about 88% hydrolysis (mole basis), and a 4% solution has a viscosity of about 50±5 cP (according to the manufacturer specifications). Foams were prepared using 1% by weight (as product in the foaming formulation) of the Hercobond™ 7700 in the presence of Selvol™ 540 prior to application to the wet formed sheets. Foam treated sheets using Macat® AO-12 and Triton™ BG-10 were also prepared, and a sample was also prepared using wet-end addition of the strength additive. Dry and wet (rewetted) tensile strengths of the sheets were measured. The results of the tensile strength testing for the Selvol™ 540 and 1% Hercobond™ 7700 handsheet samples are shown in FIG. 19. The handsheets evaluated in FIG. 19 are described below in Table XVII.

TABLE XVII

| Handsheets | Foaming Agent Utilized | Charge of Foaming Agent | Amount of Synthetic Strength Additive I |
|---|---|---|---|
| Handsheet 154 (Comparative) | — | — | — |
| Handsheet 155 (Exemplary) | Exemplary Foaming Agent I | Amphoteric | 1 wt. % |
| Handsheet 156 (Exemplary) | Exemplary Foaming Agent II | Non-ionic | 1 wt. % |
| Handsheet 157 (Exemplary) | Exemplary Foaming Agent III | Non-ionic | 1 wt. % |
| Handsheet 158 (Comparative) | — | — | 4 lbs/ton (Wet-end addition) |

Exemplary Foaming Agent I includes an amine oxide which is amphoteric and commercially available from Pilot Chemical under the trade name Macat® AO-12.

Exemplary Foaming Agent II includes an alkyl polyglucoside which is non-ionic and commercially available from Dow Chemical under the trade name Triton™ BG-10.

Exemplary Foaming Agent III includes a polyvinyl alcohol which is non-ionic and commercially available from Solenis LLC of Wilmington, Del., under the trade name DeTac™ and from Sekisui Specialty Chemicals of Dallas, Tex., under the trade name Selvol™ 540.

Synthetic Strength Additive I includes a graft copolymer of a vinyl monomer and functionalized vinyl amine which is cationic and commercially available from Solenis LLC of Wilmington, Del., under the trade name Hercobond™ 7700.

The results show that the use of the polymeric foaming agent Selvol™ 540 in concert with dry strength additive Hercobond™ 7700 resulted in significant strength improvements as compared to the untreated control. The dry tensile strength gain for the Selvol™ 540 foam-treated sheet was 22% over that of the control, while the foam treated sheets using Macat® AO-12 and Triton™ BG-10 showed equivalent performance as the sample prepared via wet end addition and showed a 10% improvement over that of the untreated control.

Example 3D

Figure 20:
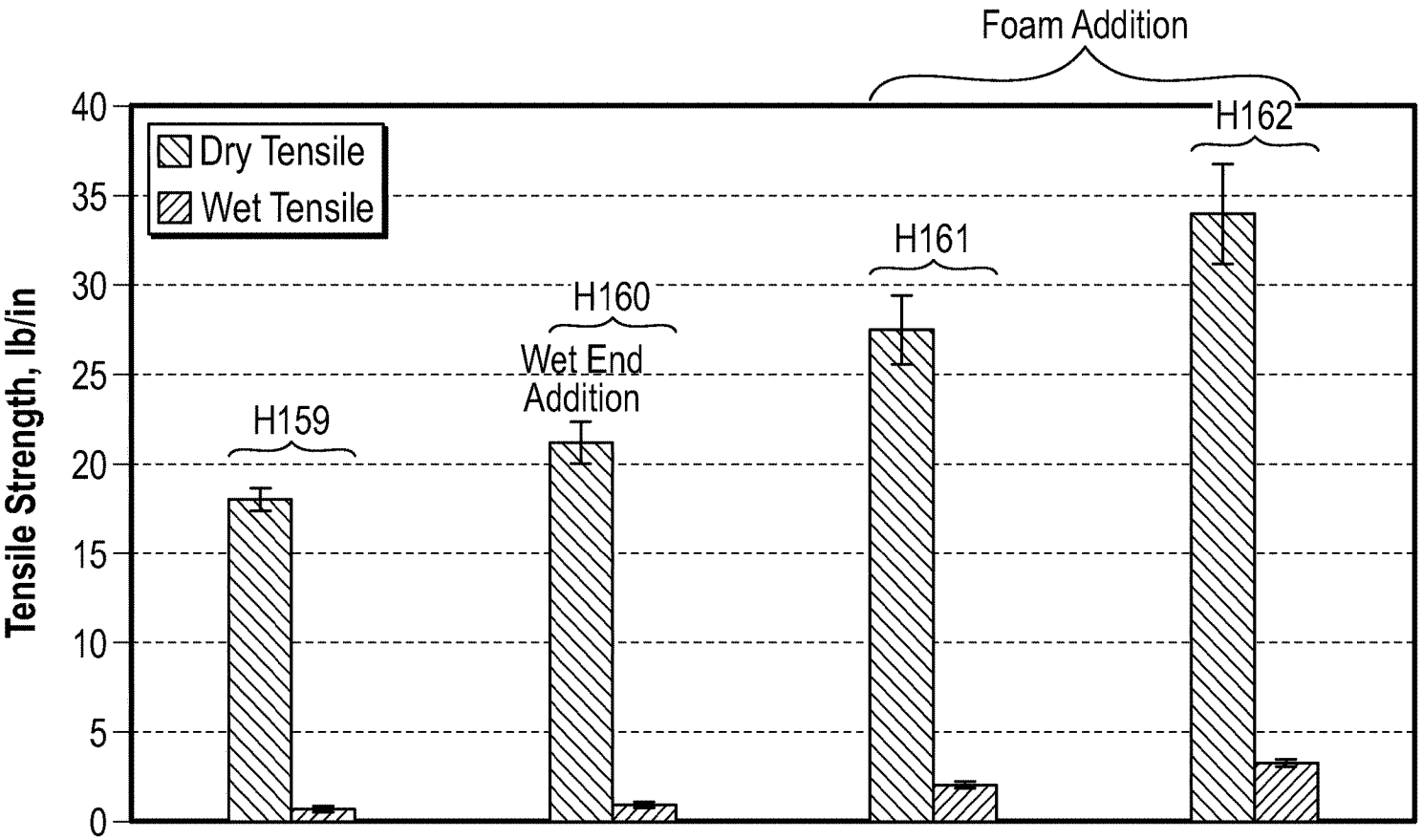
FIG. 20 shows another graph of dry and wet tensile strength results for different foaming agents on recycled linerboard samples.

Handsheets of about 100 gsm were produced using the same equipment and procedures described above in Example 3A, using 370 CSF recycled linerboard pulp. To confirm that a dosage response and similar improvements in strength properties cannot be observed by adding Selvol™ 540 and Hercobond™ 7700 strength additives via wet-end addition, identical handsheet conditions were used to create handsheet samples by the wet-end addition of 4 lb./ton Hercobond™ 7700 and 20 lb/ton Selvol™ 540, by the foam assisted addition of 1% Hercobond™ 7700 foam produced with the foaming agent Selvol™ 540, and by the foam assisted addition of 5% Hercobond™ 7700 foam with Selvol™ 540. The handsheets of about 100 gsm were produced using the same equipment and procedures described above with respect to Example 3A using 370 CSF recycled linerboard pulp. The tensile strength of these samples was then measured, together with a control. The results of tensile strength comparison for these handsheets are shown in FIG. 20. The handsheets evaluated in FIG. 20 are described below in Table XVIII.

TABLE XVIII

| Handsheets | Foaming Agent Utilized | Amount of Foaming Agent | Amount of Synthetic Strength Additive I |
|---|---|---|---|
| Handsheet 159 (Comparative) | — | — | — |
| Handsheet 160 (Comparative) | Exemplary Foaming Agent III | 20 lbs/ton (Wet-end addition) | 4 lbs/ton (Wet-end addition) |

TABLE XVIII-continued

| Handsheets | Foaming Agent Utilized | Amount of Foaming Agent | Amount of Synthetic Strength Additive I |
|---|---|---|---|
| Handsheet 161 (Exemplary) | Exemplary Foaming Agent III | 0.6 wt. % | 1 wt. % |
| Handsheet 162 (Exemplary) | Exemplary Foaming Agent III | 1 wt. % | 5 wt. % |

Exemplary Foaming Agent III includes a polyvinyl alcohol which is non-ionic and commercially available from Solenis LLC of Wilmington, Del., under the trade name DeTac™ and from Sekisui Specialty Chemicals of Dallas, Tex., under the trade name Selvol™ 540.

Synthetic Strength Additive I includes a graft copolymer of a vinyl monomer and functionalized vinyl amine which is cationic and commercially available from Solenis LLC of Wilmington, Del., under the trade name Hercobond™ 7700.

As can be seen in FIG. 20, the tensile strength gains for the 1% Hercobond™ 7700 foam-treated sheet using Selvol™ 540 as the foaming agent were more than double that of the wet end addition, indicating the foam application advantageously resulted in both large wet (rewetted) tensile strength and dry tensile strength gains. In addition, a dosage response is observed with the foam assisted addition samples, with the 5% Hercobond™ 7700 foam (with Selvol™ 540 used as the foaming agent) showing a still greater increase in dry tensile strength and wet (rewetted) tensile strength as compared to the untreated control sheet.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A foaming formulation for producing a foam with a gas content upon incorporation of gas into the foaming formulation, the foaming formulation comprising:

at least one foaming agent in an amount of from about 0.001% to about 10%, based on a total weight of the foaming formulation, wherein the at least one foaming agent comprises at least one of:

(a) a nonionic foaming agent selected from the group of ethoxylates, alkoxylated fatty acids, polyethoxy esters, glycerol esters, polyol esters, hexitol esters, fatty alcohols, alkoxylated alcohols, alkoxylated alkyl phenols, alkoxylated glycerin, alkoxylated amines, alkoxylated diamines, fatty amide, fatty acid alkylol amide, alkoxylated amides, alkoxylated imidazoles, fatty amide oxides, alkanol amines, alkanolamides, polyethylene glycol, ethylene and propylene oxide, EO/PO copolymers and their derivatives, polyester, alkyl saccharides, alkyl, polysaccharide, alkyl glucosides, alkyl polyglucosides, alkyl glycol ether, polyoxyalkylene alkyl ethers, polyvinyl alcohols and their derivatives, alkyl polysaccharides, and combinations thereof;

(b) a zwitterionic or amphoteric foaming agent selected from the group of lauryl dimethylamine oxide, cocoamphoacetate, cocoamphodiacetate, cocoamphodipropionate, cocamidopropyl betaine, alkyl betaine, alkyl amido betaine, hydroxysulfo betaine, cocamidopropyl hydroxysultain, alkyliminodipropionate, amine oxide, amino acid derivatives, alkyl dimethylamine oxide and combinations thereof;

(c) a cationic foaming agent selected from the group of alkyl amine and amide and their derivatives, alkyl ammoniums, alkoxylated amide and their derivatives, fatty amine and fatty amide and their derivatives, quaternary ammoniums, alkyl quaternary ammoniums and their derivatives and their salts, imidazolines derivatives, alkyl ammonium salts, alkyl phosphonium salts, polymers and copolymers of structures described above, and combinations thereof; or a combination of the same type or more than one type of the aforementioned foaming agents;

at least one synthetic strength additive in an amount of from about 0.01% to about 50%, based on the total weight of the foaming formulation, wherein the at least one synthetic strength additive comprises a cationic functional group, wherein the at least one synthetic strength additive is a nitrogen-containing cationic polymer, and wherein the at least one synthetic strength additive comprising a cationic functional group is selected from the group of:

DADMAC-acrylamide copolymers, with or without subsequent glyoxylation, polymers and copolymers of acrylamide with cationic groups comprising AETAC, AETAS, METAC, METAS, APTAC, MAPTAC, DMAEMA, or combinations thereof, with or without subsequent glyoxylation, vinylamine containing polymers and copolymers, PAE polymers, polyethyleneimines, poly-DADMACs, polyamines, polymers based upon dimethylaminomethyl-substituted acrylamide, and combinations thereof;

wherein DADMAC is diallyldimethylammonium chloride, DMAEMA is dimethylaminoethylmethacrylate, AETAC is acryloyloxyethyltrimethyl chloride, AETAS is acryloyloxyethyltrimethyl sulfate, METAC is methacryloyloxyethyltrimethyl chloride, METAS is methacryloyloxyethyltrimethyl sulfate, APTAC is acryloylamidopropyltrimethylammonium chloride, MAPTAC is acryloylamidopropyltrimethylammonium chloride, and PAE is polyamidoamineepichlorohydrin polymers; and water.

2. The foaming formulation of claim 1, wherein the at least one foaming agent comprises a polyvinyl alcohol or a polyvinyl alcohol derivative.

3. The foaming formulation of claim 2, wherein the polyvinyl alcohol or polyvinyl alcohol derivative has a degree of hydrolysis between around 70% and 99.9%.

4. The foaming formulation of claim 2, wherein the polyvinyl alcohol or polyvinyl alcohol derivative has a molecular weight of between around 5000 and 400,000.

5. The foaming formulation of claim 2, wherein the polyvinyl alcohol or polyvinyl alcohol derivative has a viscosity of between around 3 and 75 cP at 4% solids and 20° C.

6. The foaming formulation of claim 1, wherein the at least one synthetic strength additive comprising a cationic functional group has a primary amine functionality of about 1 to 100%, on a mole basis.

7. The foaming formulation of claim 1, wherein the hydrophilic-lipophilic balance of the foaming formulation is greater than about 8.

8. A foaming formulation for producing a foam with a gas content upon incorporation of gas into the foaming formulation, the foaming formulation comprising:

at least one foaming agent in an amount of from about 0.001% to about 10% based on a total weight of the foaming formulation, wherein the at least one foaming agent comprises at least one of:

(a) a nonionic foaming agent selected from the group of ethoxylates, alkoxylated fatty acids, polyethoxy esters, glycerol esters, polyol esters, hexitol esters, fatty alcohols, alkoxylated alcohols, alkoxylated alkyl phenols, alkoxylated glycerin, alkoxylated amines, alkoxylated diamines, fatty amide, fatty acid alkylol amide, alkoxylated amides, alkoxylated imidazoles, fatty amide oxides, alkanol amines, alkanolamides, polyethylene glycol, ethylene and propylene oxide, EO/PO copolymers and their derivatives, polyester, alkyl saccharides, alkyl, polysaccharide, alkyl glucosides, alkyl polyglucosides, alkyl glycol ether, polyoxyalkylene alkyl ethers, polyvinyl alcohols and their derivatives, alkyl polysaccharides, and combinations thereof;

(b) a zwitterionic or amphoteric foaming agent selected from the group of lauryl dimethylamine oxide, cocoamphoacetate, cocoamphodiacetate, cocoamphodipropionate, cocamidopropyl betaine, alkyl betaine, alkyl amido betaine, hydroxy sulfo betaine, cocamidopropyl hydroxysultain, alkyliminodipropionate, amine oxide, amino acid derivatives, alkyl dimethylamine oxide and combinations thereof;

(c) a cationic foaming agent selected from the group of alkyl amine and amide and their derivatives, alkyl ammoniums, alkoxylated amide and their derivatives, fatty amine and fatty amide and their derivatives, quaternary ammoniums, alkyl quaternary ammoniums and their derivatives and their salts, imidazolines derivatives, alkyl ammonium salts, alkyl phosphonium salts, polymers and copolymers of structures described above, and combinations thereof; or a combination of the same type or more than one type of the aforementioned foaming agents;

at least one synthetic strength additive in an amount of from about 0.01% to about 50%, based on the total weight of the foaming formulation, the at least one synthetic strength additive comprising a cationic functional group, wherein the at least one synthetic strength additive is a nitrogen-containing cationic polymer, and wherein the at least one synthetic strength additive comprising a cationic functional group is selected from the group of:

DADMAC-acrylamide copolymers, with or without subsequent glyoxylation, polymers and copolymers of acrylamide with cationic groups comprising AETAC, AETAS, METAC, METAS, APTAC, MAPTAC, DMAEMA, or combinations thereof, with or without subsequent glyoxylation, vinylamine containing polymers and copolymers, PAE polymers, polyethyleneimines, poly-DADMACs, polyamines, polymers based upon dimethylaminomethyl-substituted acrylamide, and combinations thereof;

wherein DADMAC is diallyldimethylammonium chloride, DMAEMA is dimethylaminoethylmethacrylate, AETAC is acryloyloxyethyltrimethyl chloride, AETAS is acryloyloxyethyltrimethyl sulfate, METAC is methacryloyloxyethyltrimethyl chloride, METAS is methacryloyloxyethyltrimethyl sulfate, APTAC is acryloylamidopropyltrimethylammonium chloride, MAPTAC is acryloylamidopropyltrimethylammonium chloride, and PAE is polyamidoamineepichlorohydrin polymers; and water;

wherein the concentration of the at least one foaming agent in the foaming formulation is substantially minimally sufficient to produce the gas content of the foam after gas is incorporated into the foaming formulation.

9. The foaming formulation of claim 8, wherein the gas content for the foam produced after the incorporation of gas into the foaming formulation is from about 40% gas to about 95% gas, based on a total volume of the foam.

10. The foaming formulation of claim 8, wherein the gas content for the foam produced after the incorporation of gas into the foaming formulation is from about 60% gas to about 80% gas, based on a total volume of the foam.

11. The foaming formulation of claim 8, wherein the hydrophilic-lipophilic balance of the foaming formulation is greater than about 8.

12. The foaming formulation of claim 8, wherein the at least one synthetic strength additive comprising a cationic functional group has a primary amine functionality of about 1 to 100%, on a mole basis.

13. A method of introducing a synthetic cationic strength additive into paper product, comprising:

producing a foam from a foaming formulation, the foaming formulation comprising:

at least one foaming agent in an amount of from about 0.001% to about 10% by weight based on a total weight of the foaming formulation, wherein the at least one foaming agent comprises at least one of:

(a) a nonionic foaming agent selected from the group of ethoxylates, alkoxylated fatty acids, polyethoxy esters, glycerol esters, polyol esters, hexitol esters, fatty alcohols, alkoxylated alcohols, alkoxylated alkyl phenols, alkoxylated glycerin, alkoxylated amines, alkoxylated diamines, fatty amide, fatty acid alkylol amide, alkoxylated amides, alkoxylated imidazoles, fatty amide oxides, alkanol amines, alkanolamides, polyethylene glycol, ethylene and propylene oxide, EO/PO copolymers and their derivatives, polyester, alkyl saccharides, alkyl, polysaccharide, alkyl glucosides, alkyl polyglucosides, alkyl glycol ether, polyoxyalkylene alkyl ethers, polyvinyl alcohols and their derivatives, alkyl polysaccharides, and combinations thereof;

(b) a zwitterionic or amphoteric foaming agent selected from the group of lauryl dimethylamine oxide, cocoamphoacetate, cocoamphodiacetate, cocoamphodipropionate, cocamidopropyl betaine, alkyl betaine, alkyl amido betaine, hydroxy sulfo betaine, cocamidopropyl hydroxysultain, alkyliminodipropionate, amine oxide, amino acid derivatives, alkyl dimethylamine oxide and combinations thereof;

(c) a cationic foaming agent selected from the group of alkyl amine and amide and their derivatives, alkyl ammoniums, alkoxylated amide and their derivatives, fatty amine and fatty amide and their derivatives, quaternary ammoniums, alkyl quaternary ammoniums and their derivatives and their salts, imidazolines derivatives, alkyl ammonium salts, alkyl phosphonium salts, polymers and copolymers of structures described above, and combinations thereof; or a combination of the same type or more than one type of the aforementioned foaming agents;

a synthetic strength additive in an amount from about 0.01% to about 50% by weight based on a total weight of the foaming formulation, the synthetic strength additive comprising a cationic functional group, wherein the at least one synthetic strength additive is a nitrogen-containing cationic polymer, and wherein the at least one synthetic strength additive comprising a cationic functional group is selected from the group of:

DADMAC-acrylamide copolymers, with or without subsequent glyoxylation, polymers and copolymers of acrylamide with cationic groups comprising AETAC, AETAS, METAC, METAS, APTAC, MAPTAC, DMAEMA, or combinations thereof, with or without subsequent glyoxylation, vinylamine containing polymers and copolymers, PAE polymers, polyethyleneimines, poly-DADMAC s, polyamines, polymers based upon dimethylaminomethyl-substituted acrylamide, and combinations thereof;

wherein DADMAC is diallyldimethylammonium chloride, DMAEMA is dimethylaminoethylmethacrylate, AETAC is acryloyloxyethyltrimethyl chloride, AETAS is acryloyloxyethyltrimethyl sulfate, METAC is methacryloyloxyethyltrimethyl chloride, METAS is methacryloyloxyethyltrimethyl sulfate, APTAC is acryloylamidopropyltrimethylammonium chloride, MAPTAC is acryloylamidopropyltrimethylammonium chloride, and PAE is polyamidoamine-epichlorohydrin polymers; and water, and applying the foam to a wet formed embryonic web.

14. The method of claim 13, wherein the paper product is virgin linerboard.

15. The method of claim 13, wherein the paper product is recycled linerboard.

16. The method of claim 13, wherein the paper product is bag or sack paper.

17. The method of claim 13, wherein the step of producing the foam from the foaming solution comprises at least one of: shearing the foaming solution in the presence of a gas; injecting gas into the foaming solution; or injecting the foaming solution into a gas flow.

18. The method of claim 13, wherein the step of applying foam to the wet formed embryonic web is performed when the wet formed embryonic web has a pulp fiber consistency of about 5% to about 30%.

* * * * *